US009795177B1

(12) United States Patent
Weaver

(10) Patent No.: US 9,795,177 B1
(45) Date of Patent: Oct. 24, 2017

(54) HEAD-MOUNTED IMPACT SENSING AND WARNING DEVICE

(71) Applicant: Steven Douglas Weaver, Columbus, OH (US)

(72) Inventor: Steven Douglas Weaver, Columbus, OH (US)

( * ) Notice: Subject to any disclaimer, the term of this patent is extended or adjusted under 35 U.S.C. 154(b) by 74 days.

(21) Appl. No.: 14/634,860

(22) Filed: Mar. 1, 2015

Related U.S. Application Data

(63) Continuation-in-part of application No. 13/646,694, filed on Oct. 6, 2012, now abandoned.

(60) Provisional application No. 61/626,982, filed on Oct. 6, 2011.

(51) Int. Cl.
*A61B 5/00* (2006.01)
*G08B 23/00* (2006.01)
*A42B 3/04* (2006.01)

(52) U.S. Cl.
CPC ..... *A42B 3/046* (2013.01); *A42B 3/044* (2013.01); *A42B 3/0453* (2013.01)

(58) Field of Classification Search
CPC ..... G08B 23/00
See application file for complete search history.

(56) References Cited

U.S. PATENT DOCUMENTS 4,068,613 A 1/1978 Rubey
4,177,751 A 12/1979 Rubey
4,239,014 A 12/1980 Rubey
4,470,302 A 9/1984 Carte
4,763,275 A 8/1988 Carlin
4,989,462 A 2/1991 Davis et al.
5,621,922 A 4/1997 Rush, III
6,065,158 A 5/2000 Rush, III
6,301,718 B1 10/2001 Rigal
6,332,226 B1 12/2001 Rush, III
6,798,392 B2 9/2004 Hartwell et al.
6,826,509 B2 11/2004 Crisco, III et al.
7,082,620 B1 8/2006 Rongione
(Continued)

OTHER PUBLICATIONS

Printout of webpage describing Shock Sensors for Shipping Fragile Goods from www.shockwatch.com website, dated Aug. 30, 2010.
(Continued)

*Primary Examiner* — Joseph Feild
*Assistant Examiner* — John Mortell
(74) *Attorney, Agent, or Firm* — The Law Office of Patrick F. O'Reilly III, LLC

(57) ABSTRACT

A head-mounted impact sensing and warning device includes a band adapted to be worn around at least a portion of the head or helmeted area of a user; an impact sensing device configured to sense an impact sustained by the head or the helmeted area of the user; at least one visual indicating device operatively coupled to the impact sensing device, the at least one visual indicating device configured to produce a visual indicator when the impact sensing device senses an impact that exceeds a predetermined impact level, thereby providing a visual alert that the impact sustained by the head or the helmeted area of the user exceeded the predetermined impact level; and a unit housing containing the impact sensing device and the at least one visual indicating device, the unit housing being coupled to the band or the helmeted area.

19 Claims, 19 Drawing Sheets

(56) References Cited

U.S. PATENT DOCUMENTS

| | | | | |
|---|---|---|---|---|
| 7,140,047 | B2 | 11/2006 | Kronenberger | |
| 7,509,835 | B2 | 3/2009 | Beck | |
| 7,720,530 | B2 | 5/2010 | Causevic | |
| 7,966,671 | B2 | 6/2011 | Cho | |
| 7,992,421 | B2 | 8/2011 | Jeftic-Stojanovski et al. | |
| 8,036,826 | B2 | 10/2011 | MacIntosh et al. | |
| 8,111,859 | B2 * | 2/2012 | Phillips | H04R 5/0335 381/374 |
| 2007/0089480 | A1 * | 4/2007 | Beck | A42B 3/046 73/12.01 |
| 2007/0235308 | A1 * | 10/2007 | Sharrah | H01H 9/06 200/317 |
| 2008/0186723 | A1 * | 8/2008 | Huang | B60R 1/1207 362/494 |
| 2010/0289433 | A1 * | 11/2010 | Lau | A42B 1/244 315/313 |
| 2010/0300147 | A1 * | 12/2010 | Farmer | A44C 3/00 63/3.1 |
| 2010/0307223 | A1 * | 12/2010 | Jeftic-Stojanovski | A42B 3/046 73/12.04 |
| 2013/0217977 | A9 * | 8/2013 | Cooner | A61B 5/0476 600/301 |

OTHER PUBLICATIONS

First office action on the merits (Non-Final Rejection) in U.S. Appl. No. 13/646,694, mailed on Mar. 4, 2014.
Second office action on the merits (Final Rejection) in U.S. Appl. No. 13/646,694, mailed on Aug. 29, 2014.

* cited by examiner

HEAD-MOUNTED IMPACT SENSING AND WARNING DEVICE

CROSS-REFERENCE TO RELATED APPLICATIONS

This is a continuation-in-part of U.S. patent application Ser. No. 13/646,694, entitled "Head-Mounted Concussion Sensing and Warning Device", filed on Oct. 6, 2012, and further claims the benefit of U.S. Provisional Patent Application No. 61/626,982, entitled "Headband Concussion Warning Sensor", filed on Oct. 6, 2011, the disclosure of each of which is hereby incorporated by reference as if set forth in their entirety herein.

STATEMENT REGARDING FEDERALLY SPONSORED RESEARCH OR DEVELOPMENT

Not Applicable.

NAMES OF THE PARTIES TO A JOINT RESEARCH AGREEMENT

Not Applicable.

INCORPORATION BY REFERENCE OF MATERIAL SUBMITTED ON A COMPACT DISK

Not Applicable.

BACKGROUND OF THE INVENTION

1. Field of the Invention

The invention generally relates to a head-mounted impact sensing and warning device. More particularly, the invention relates to a head-mounted impact sensing and warning device that provides a visual alert that an impact sustained by a head or a helmeted area of a user exceeded a predetermined impact level.

2. Background and Description of Related Art

Although there are various devices for measuring g-forces and impacts, which exist in the related art, not one of these known devices has the uniqueness and advantages of 1 to 360 degree impact detection allowing full range measurement of g-forces on and around the head/skull area using a simple, self-contained, band-mounted apparatus for impact detection. In addition, considering the related art, none of the patents listed has the ability of showing a variation of g-force measurement with the use of an illuminating light or change in liquid color. For example:

U.S. Pat. No. 6,826,509: A system and method for determining the magnitude of linear and rotational acceleration of and direction of impact to a body part, such as a head, includes positioning a number of single-axis accelerometers proximate to the outer surface of the body part. A number of accelerometers are oriented to sense respective linear acceleration orthogonal to the outer surface of the body part. The acceleration data sensed is collected and recorded. A hit profile function is determined from the configuration of the body part and the positioning of the plurality of accelerometers thereabout. A number of potential hit results are generated from the hit profile function and then compared to the acceleration data sensed by the accelerometers. One of the potential hit results is best fit matched to the acceleration data to determine a best fit hit result, which yields the magnitude of linear acceleration to and direction of an impact to the body part. The rotational acceleration of the body part can also be estimated from the magnitude of linear acceleration of and direction of the impact to the body part.

U.S. Pat. No. 4,068,613: A device for affording an indication when a predetermined mechanical shock has been received, characterized by a base, or means for attaching to a container to be monitored; structure for measuring when a predetermined acceleration has been received by the container and the device; and an indicator for indicating to an observer that the shock has been received. Disclosed are devices having (1) a mechanical structure with a breaking point; (2) a mechanical structure with a biasing means; and (3) a structure employing an interfacial tension phenomenon. The devices may be of the "go-no-go" type or may afford an indication and history of the shock, or acceleration forces, received. Also disclosed are the specific details of the respective embodiments.

U.S. Pat. No. 4,239,014: An apparatus which responds to a predetermined acceleration wherein a droplet of liquid is suspended by a holding means which prevents the droplet from escaping, except that when an acceleration of the holding means occurs which is greater than a predetermined acceleration, then at least a portion of the droplet escapes from the holding means.

U.S. Pat. No. 4,470,302: An indicating shipping accelerometer having a transparent tube within which an inertial mass moves indicators relative to a scale affixed to the transparent tube to give an indication of the maximum shock incurred in either direction of its longitudinal axis. Springs on either side of the inertial mass maintain the inertial mass in its initial position. The unit may be reset for reuse by inserting a wire through the endcaps and repositioning the indicators.

U.S. Pat. No. 7,966,671: Disclosed is a headwear which has remarkably improved stretch property and comfortably fits the head of a wearer. The headwear comprises a head receiving part made of a multiple fabric and a sweatband peripherally attached to an inner side of the head receiving part along a lower edge thereof. Since the multiple fabric has much more improved stretch property than the stretchable fabric of the conventional free size cap, the headwear can fit a very wide range of head sizes and provide a comfortable sense of wearing, without any sense of pressing even though the cap is used for a long time.

U.S. Pat. No. 7,140,047: The combination of a headwear piece, an accessory, and a plurality of discrete elements. The headwear piece has a crown defining an opening through which a wearer's head can project with the headwear piece in an operative position on the wearer's head. The crown has an inside surface with a portion for frictionally engaging a wearer's head with the headwear piece in the operative position and a first layer having an exposed outer surface. The accessory and plurality of discrete elements are magnetically attracted to each other through the first layer to releasably maintain the accessory in a stored state on the headwear piece. The plurality of discrete elements includes at least first and second discrete elements that are adjacent to each other so as to cooperatively cause a localized magnetic attractive force to be generated between the accessory and the first and second discrete elements.

U.S. Pat. No. 7,082,620: A head protective device incorporating a sweat band bandana having a front portion secured to a head protective device and the rear portion bandana unsecured. The bandana in the first position has the free ends of the bandana overlapping and stored within the head encircling member of the head protective device although the ends may also extend down for tying. A second position has the bandana extending downwardly from the head protective device and the bandana has the free ends tied behind the head for the purpose of securing the head protective device against accidental removal.

The above listed related art only pertain to the head-mounted impact sensing and warning device in regards to devices that measure or detect g-force impacts, magnitude of linear and rotational acceleration of and direction of impact.

Other related art only pertains to the head-mounted impact sensing and warning device regarding a headband or bandana that the headwear can fit a very wide range of head sizes and provide a comfortable sense of wearing and that there are first and second discrete elements that are adjacent to each other so as to cooperatively cause a localized magnetic attractive force to be generated between the accessory and the first and second discrete elements.

Therefore, what is needed is a head-mounted impact sensing and warning device that enables 1 to 360 degree impact detection allowing full range measurement of g-forces on and around the head/skull area. In addition, there is a need for a head-mounted impact sensing and warning device that is capable of showing a variation of g-force measurement with the use of an illuminating light or change in liquid color.

BRIEF SUMMARY OF EMBODIMENTS OF THE INVENTION

Accordingly, the present invention is directed to a head-mounted impact sensing and warning device that substantially obviates one or more problems resulting from the limitations and deficiencies of the related art.

In accordance with one or more embodiments of the present invention, there is provided a head-mounted impact sensing and warning device. The head-mounted impact sensing and warning device including a band adapted to be worn around at least a portion of the head or helmeted area of a user; an impact sensing device configured to sense an impact sustained by the head or the helmeted area of the user; at least one visual indicating device operatively coupled to the impact sensing device, the at least one visual indicating device configured to produce a visual indicator when the impact sensing device senses an impact that exceeds a predetermined impact level, thereby providing a visual alert that the impact sustained by the head or the helmeted area of the user exceeded the predetermined impact level; and a unit housing containing the impact sensing device and the at least one visual indicating device, the unit housing being coupled to the band or the helmeted area.

In a further embodiment of the present invention, the band comprises one of the following: (i) a headband; (ii) a bandana; and (iii) a strap for securing glasses or goggles around the head or the helmeted area of the user.

In yet a further embodiment, the band comprises one of the following materials: (i) a moisture-wicking material; (ii) polyester; (iii) a moisture management antimicrobial performance fabric; (iv) spandex; (v) cotton; (vi) a cotton blend; (vii) a polyester/spandex mix; (viii) elastic; (ix) leather; (x) nylon; (xi) silicone; and (xii) rubber.

In still a further embodiment, the impact sensing device comprises an accelerometer.

In yet a further embodiment, the at least one visual indicating device comprises at least one light emitting device, the at least one light emitting device configured to emit one or more beams of light when the impact sensing device senses an impact exceeding the predetermined impact level.

In still a further embodiment, the head-mounted impact sensing and warning device further comprises a power source for powering the impact sensing device and the at least one light emitting device.

In yet a further embodiment, the unit housing containing the impact sensing device and the at least one visual indicating device is attached to the band by means of a clipping mechanism, the clipping mechanism including a first clip member, a second clip member, and one or more flexible hinges connecting the first clip member to the second clip member, the second clip member configured to rotate relative to the first clip member, the clipping mechanism being integrally formed with the unit housing.

In still a further embodiment, the unit housing containing the impact sensing device and the at least one visual indicating device is removably disposed within at least one pocket of the band, the at least one pocket being formed between layers of the band or being attached to a front layer of the band, the at least one pocket including at least one aperture or a viewing window such that the visual indicator produced by the at least one visual indicating device is externally visible.

In yet a further embodiment, the impact sensing device comprises an accelerometer operatively connected to a circuit board, the at least one visual indicating device comprises at least one light emitting device, and wherein the head-mounted impact sensing and warning device further comprises a battery operatively coupled to the accelerometer and the at least one light emitting device, the battery configured to power the accelerometer and the at least one light emitting device.

In still a further embodiment, the head-mounted impact sensing and warning device further comprises a reset device for resetting the head-mounted impact sensing and warning device back to an original setting after the at least one light emitting device has emitted one or more beams of light indicative of the impact sensing device sensing an impact exceeding the predetermined impact level.

In yet a further embodiment, the impact sensing device and the at least one visual indicating device are combined in the form of at least one liquid-filled tube, at least a portion of a liquid disposed in the at least one liquid-filled tube configured to change color when an impact exceeding the predetermined impact level is sensed by the at least one liquid-filled tube.

In still a further embodiment, one portion of the liquid in the at least one liquid-filled tube comprises a clear or transparent liquid and another portion of the liquid in the at least one liquid-filled tube comprises a colored dye, the colored dye being held in suspension with respect to the clear or transparent liquid such that, when the at least one liquid-filled tube is subjected to an impact that exceeds the predetermined impact level, the impact disrupts the surface tension of the colored dye, thereby dispersing the colored dye along an axial length of the at least one liquid-filled tube so as to provide a visual alert that the impact sustained by the head or the helmeted area of the user exceeded the predetermined impact level.

In yet a further embodiment, the at least one liquid-filled tube is capable of 360 degree impact detection, thereby allowing full range measurement of g-forces on and around the head or the helmeted area of the user.

In accordance with one or more other embodiments of the present invention, there is provided a head-mounted impact sensing and warning device. The head-mounted impact sensing and warning device includes a band adapted to be worn around at least a portion of the head or helmeted area of a user; a unit housing coupled to the band; a clipping mechanism attached to the unit housing; an acceleration sensing device configured to sense an acceleration sustained by the head or the helmeted area of the user, the acceleration sensing device disposed inside the unit housing; a plurality of visual indicating devices operatively coupled to the acceleration sensing device within the unit housing, each of the plurality of visual indicating devices configured to produce a visual indicator when the acceleration sensing device senses an acceleration that exceeds a predetermined acceleration value, thereby providing a visual alert that an impact sustained by the head or the helmeted area of the user exceeded the predetermined acceleration value; and a power source operatively coupled to the acceleration sensing device and the plurality of visual indicating devices, the power source configured to power the acceleration sensing device and each of the plurality of visual indicating devices.

In a further embodiment of the present invention, the acceleration sensing device comprises an accelerometer, the accelerometer configured to measure the magnitude of linear and rotational acceleration, the accelerometer further configured to detect the direction of the acceleration, and to measure peak acceleration and a duration of an acceleration pulse In yet a further embodiment, the predetermined acceleration value is determined by a predetermined acceleration setting of the accelerometer, the predetermined acceleration setting of the accelerometer being adjustable in the range from approximately 5 g forces to approximately 500 g forces, and the predetermined acceleration setting of the accelerometer being adjustable in increments of approximately 2 g forces.

In still a further embodiment, the accelerometer is capable of 360 degree acceleration measurement, thereby allowing full range measurement of g-forces on and around the head or the helmeted area of the user.

In yet a further embodiment, the acceleration sensing device is operatively connected to a circuit board, and each of the plurality of visual indicating devices comprises a light emitting device, and wherein the head-mounted impact sensing and warning device further comprises a microcontroller configured to process acceleration data sensed by the acceleration sensing device.

In still a further embodiment, the plurality of visual indicating devices are disposed within the unit housing, and wherein the unit housing is substantially transparent such that the visual indicators produced by the plurality of visual indicating devices are visible through the unit housing.

In yet a further embodiment, at least one of the plurality of visual indicating devices passes through an aperture in the circuit board such that the visual indicator produced by the at least one of the plurality of visual indicating devices is visible through two opposed sides of the unit housing.

In still a further embodiment, the head-mounted impact sensing and warning device further comprises a motion sensing device, the motion sensing device configured to sense a motion imparted on the head-mounted impact sensing and warning device by one or more external forces and to output a signal to the microcontroller, whereby, upon receiving the signal from the motion sensing device, the microcontroller is configured to change the head-mounted impact sensing and warning device from an inactive mode to an active mode.

In accordance with yet one or more other embodiments of the present invention, there is provided a head-mounted impact sensing and warning device. The head-mounted impact sensing and warning device includes a band adapted to be worn around at least a portion of the head or helmeted area of a user; a unit housing coupled to the band; an accelerometer configured to sense an acceleration sustained by the head or the helmeted area of the user and to output a signal comprising acceleration data, the accelerometer disposed inside the unit housing; a plurality of light emitting devices operatively coupled to the accelerometer within the unit housing, each of the plurality of light emitting devices configured to emit one or more beams of light when the accelerometer senses an acceleration that exceeds a predetermined acceleration value, thereby providing a visual alert that an impact sustained by the head or the helmeted area of the user exceeded the predetermined acceleration value; a microcontroller operatively coupled to the accelerometer and the plurality of light emitting devices, the microcontroller configured to process acceleration data sensed by the accelerometer, and to selectively activate the plurality of light emitting devices when the acceleration sensed by the accelerometer exceeds the predetermined acceleration value, the microcontroller disposed inside the unit housing; and a power source operatively coupled to the accelerometer, the plurality of light emitting devices, and the microcontroller, the power source configured to power the accelerometer, each of the plurality of light emitting devices, and the microcontroller, the power source disposed inside the unit housing.

In a further embodiment of the present invention, the unit housing comprises a clipping mechanism attached to a side thereof, the clipping mechanism including a base portion and at least one clip portion, the at least one clip portion being connected to the base portion of the clipping mechanism by a flexible hinge, and the at least one clip portion being configured to rotate relative to the base portion of the clipping mechanism about the flexible hinge.

It is to be understood that the foregoing background and general description, and the following detailed description of the preferred embodiment(s) of the present invention, are merely exemplary and explanatory in nature. As such, the foregoing background and general description, and the following detailed description of the preferred embodiment(s) of the invention, should not be construed to limit the scope of the appended claims in any sense.

BRIEF DESCRIPTION OF THE SEVERAL VIEWS OF THE DRAWINGS

The invention will now be described, by way of example, with reference to the accompanying drawings, in which.

Throughout the figures, the same parts are always denoted using the same reference characters so that, as a general rule, they will only be described once.

DETAILED DESCRIPTION OF EMBODIMENTS OF THE INVENTION

Figure 1:
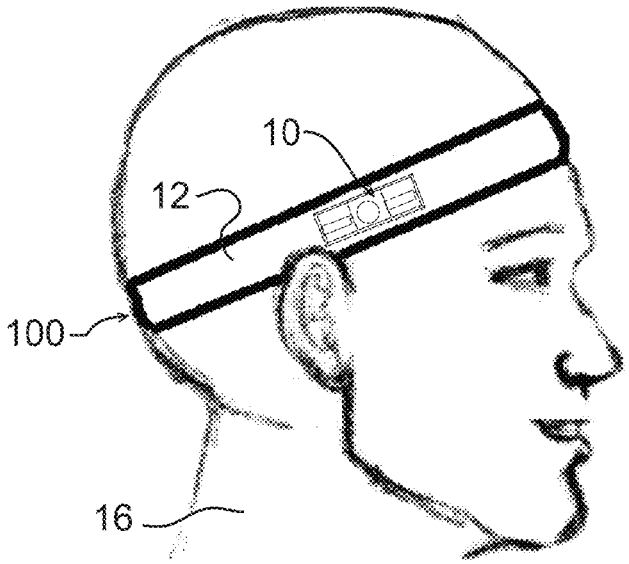
FIG. 1 is a side view of a head/skull of a user with a head-mounted impact sensing and warning device disposed around the forehead and back of the head/skull according to a first embodiment of the invention, wherein the band of the device is in the form of a headband and the impact sensing and warning assembly comprises electronic components.

One embodiment of the head-mounted impact sensing and warning device combines an impact sensing and visual indicating device attached onto, into or clipped onto or into a headband, bandana or a strap that secures glasses or goggles around the head/skull or helmeted area which illuminates or changes color when a specific and predetermined impact level has been recorded, reached or measured to provide immediate visual notification thus alerting through the visual display that the hit or blow to the head/skull or helmeted area exceeded the predetermined impact level.

In one or more embodiments, the head-mounted impact sensing and warning device is a headband, bandana or strap to secure glasses or goggles which is made from a moisture wicking material, polyester, moisture management antimicrobial performance fabric, spandex, cotton, cotton blend, polyester/spandex mix, elastic, leather, silicone, rubber, nylon and has a pocket or pockets, a clip or clips, on the outside, inside or between layers of the material, is attached on the outside, inside or between the layers either by stitching, glue, adhesive, magnetic force, brackets, clips or rivets, and is comprised of having a visible area in the pocket, pockets, clip or clips to allow for an impact sensing and visual indicating device to be permanently attached, inserted and/or secured to the headband, bandana or strap to secure glasses or goggles to view an illuminating device and its change in color when a specific and predetermined impact has been recorded, reached or measured to the wearer's head/skull or helmet area thus alerting that the hit or blow to the head/skull or helmet area exceeded a predetermined impact level.

In some embodiments of the invention, the accelerometer impact detection device connects an accelerometer to a circuit board, a battery, a programmable button and an illumination device into a housing unit.

The accelerometer impact detection device measures or detects g-force impacts, magnitude of linear and rotational acceleration of and direction of impacts and has a specific and predetermined impact settings ranging from 5 g forces to 500 g forces, in increments of 2 g forces, to illuminate when the specific and predetermined impact has been recorded, reached or measured. The accelerometer impact detection device is also designed to determine specific amplitudes, magnitudes and durations as well as angular accelerations experienced during an impact to calculate a g-force impact. Additionally, the acceleration of an impact's time history and the sensor can also measure the peak acceleration and the duration of the acceleration pulse during an impact and can sense up to 360 degree impact detection allowing full range measurement of g-forces on and around the head/skull or helmeted area.

Once the specific and predetermined impact has been reached, recorded or measured, and thus the illumination device has been activated, a programmable button can be utilized to reset the accelerometer impact detection device back to its original setting to be utilized again.

Additionally, one or embodiments of the present invention result in combining and connecting an impact indicating detection device such as a liquid/water based tube or tubes impact detection device into a housing unit.

The liquid/water based tube or tubes impact detection device comprises a liquid/water based tube or tubes, with one-half being of a clear liquid and the other half having a dye, has a visual display that changes color because an impact with a specific amplitude and duration is experienced, reached or measured and that impact is greater than the surface tension of a specific and predetermined force to the liquid. The liquid/water based tube impact detection device can determine up to 360 degree impacts, amplitude and durations allowing full range measurement of g-forces on and around the head/skull or helmeted area.

In one or more embodiments, the head-mounted impact sensing and warning device is a headband which comprises a pocket or pockets on the outside or between the layers of the headband and/or a clipping mechanism attached or clipped to the inside or outside of a headband, bandana or strap securing glasses or goggles. A liquid/water based tube g-force impact detection device or an accelerometer impact detection device attached to an illumination device (i.e., now referred to as "g-force impact indicator") is securely attached or inserted into the pocket attached to the outside or inside between the layers of the headband and/or securely attached to a clipping mechanism which is attached or clipped to the inside or outside of a headband, bandana or strap securing glasses or goggles. A g-force impact indicator can be permanently attached inside the pocket, or a clipping mechanism of a headband bandana or strap securing glasses or goggles and/or a g-force impact indicator may be removable from a pocket or clipping mechanism and replaced once activated by simply re-inserting a new g-force impact indicator into the pocket or pockets and/or onto the clipping mechanism onto a headband, bandana or strap securing glasses or goggles.

The headband is uniquely designed with the use of a pocket or pockets and/or a clip or clips, either comprised of clear material or has a center hole in the pocket which is attached either by stitching, glue adhesive, magnetic force, brackets, clip or clips, or rivets onto the outside of the headband, bandana or strap securing glasses or goggles and/or in between layers of material comprising the headband, bandana or strap securing glasses or goggles.

The head-mounted impact sensing and warning device results in combining and connecting the liquid/water based tube impact detection device in a housing unit and/or an accelerometer impact detection device connected to an illumination device and a housing unit onto, in between, or in a pocket of a headband, bandana or strap securing glasses or goggles.

The head-mounted impact sensing and warning device described herein that combines a g-force impact indicator detection device onto, into or clipped onto a headband, which changes color or illuminates when a specific and/or predetermined g-force level has been reached or measured, to a headband, bandana or strap securing glasses or goggles provides substantially immediate visual notification that the predetermined g-force level has been reached or measured to the wearer's head/skull or helmeted area, thus alerting one that the hit or blow to the head/skull or helmeted area exceed the predetermined g-force level.

The primary intended use of the head-mounted impact sensing and warning device is for athletes participating in various sports, but not limited to sports, to include such sports as football, hockey, baseball, softball, lacrosse, field hockey, volleyball, soccer, cheerleading, skiing, skateboarding, snowboarding, snowmobiling, ATV, motocross, BMX, basketball, cricket, rugby, flag football, etc. to let the player, coach, trainer, or parent know when a player has taken or received a hit or blow to the head/skull area that exceeded a predetermined impact level.

Sports concussions represent the majority of brain injuries in the U.S. with 1.6 to 3.8 million cases annually. Today high school athletes are 4 times more likely to suffer a concussion than they were ten years ago. Additionally, of the 502,784 concussions among 8-19 years old, 50% were sports related injuries.

Unlike the related art described above, the head-mounted impact sensing and warning device provides a headband with a g-force indicator or indicators attached to provide the first defense to the awareness of potential concussions to the wearer by providing a visual indication that the wearer has received a hit or blow to the head/skull area that exceeded a predetermined impact level.

A first embodiment of the head-mounted impact sensing and warning device is seen generally at 100 in FIG. 1. As shown in this figure, the head-mounted impact sensing and warning device 100 generally comprises a headband 12 that is disposed around the head of a user 16 and an impact sensing and warning assembly 10 that is attached to the headband 12. In this embodiment, the impact sensing device and the visual indicating device of the impact sensing and warning assembly 10 are electronic components.

Figure 2:
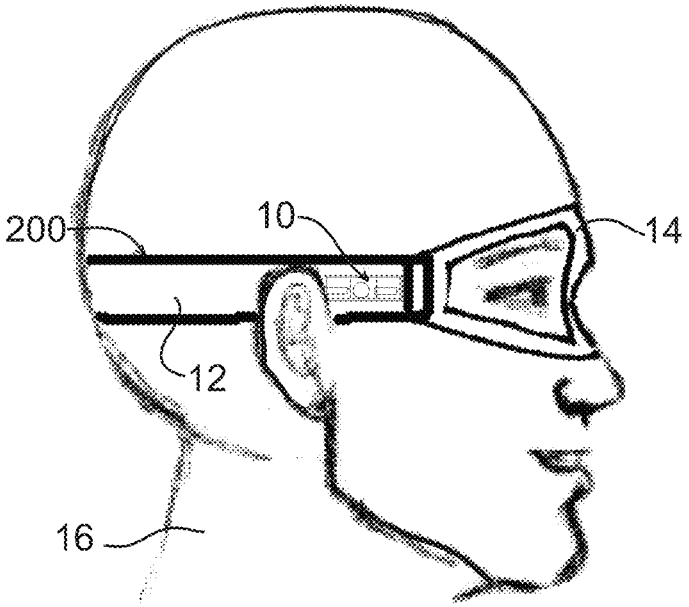
FIG. 2 is a side view of a head/skull of a user with a head-mounted impact sensing and warning device disposed around the back and side of the head/skull according to a second embodiment of the invention, wherein the band of the device is in the form of a strap for securing glasses or goggles and the impact sensing and warning assembly comprises electronic components.

A second embodiment of the head-mounted impact sensing and warning device is seen generally at 200 in FIG. 2. In this illustrated embodiment, the impact sensing and warning assembly 10 is attached to a band that is in the form of a strap 12 for securing glasses or sports goggles 14 to the head of a user 16. Like the first embodiment of the head-mounted impact sensing and warning device 100, the impact sensing and warning assembly 10 of the second embodiment comprises electronic components.

Figure 3:
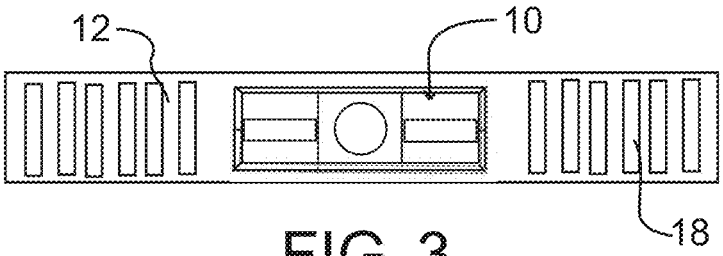
FIG. 3 is a front view illustrating a first embodiment of the headband of the head-mounted impact sensing and warning device, wherein the headband is in the form of a two-layer headband and the back layer of the headband is depicted with the first embodiment of the impact sensing and warning assembly attached thereto.
Figure 4:
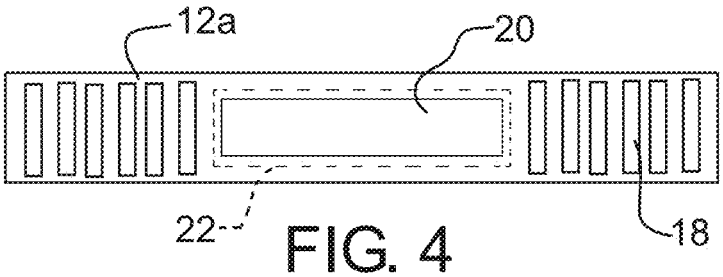
FIG. 4 is a front view illustrating the first embodiment of the headband of the head-mounted impact sensing and warning device, wherein the front layer of the headband is depicted.
Figure 5:
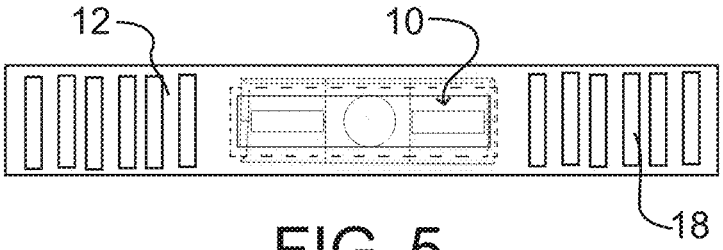
FIG. 5 is a front view illustrating the first embodiment of the headband of the head-mounted impact sensing and warning device, wherein both layers of the headband are depicted with the first embodiment of the impact sensing and warning assembly sandwiched therebetween.

Referring to FIGS. 3-5, a first embodiment of the headband 12 will now be described. As depicted in these figures, the headband 12 is constructed of two layers, namely a back (inner) layer and a front (outer) layer. In FIG. 3, the back layer of the headband is shown with an impact sensing and warning assembly 10 attached thereto. The front layer 12*a* of the headband 12 is illustrated in FIG. 4. In this figure, it can be seen that the front layer 12*a* of the headband 12 is provided with an aperture 20 therethrough so that the electronic components of the impact sensing and warning assembly 10 are visible from outside of the headband 12. In addition, it can be seen that a stitched pocket 22 is formed between the front layer 12*a* and the back layer for receiving the impact sensing and warning assembly 10. In other words, when both layers of the headband 12 are adhered together, the impact sensing and warning assembly 10 is sandwiched between the front layer 12*a* and the back layer of the headband 12 (see FIG. 5, which depicts the impact sensing and warning assembly 10 sandwiched between the two layers of the headband 12). In addition, as shown in FIGS. 3-5, the illustrated headband 12 is provided with a plurality of textured indentations and/or protrusions 18 disposed along the length thereof.

Figure 6:
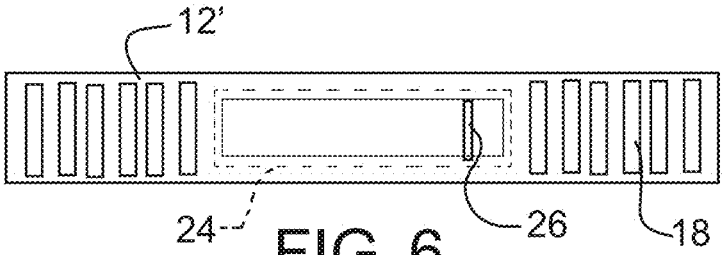
FIG. 6 is a front view illustrating a second embodiment of the headband of the head-mounted impact sensing and warning device, wherein a pocket is provided externally on the front layer of the headband and the front of the pocket comprises an aperture for exposing a front portion of the impact sensing and warning assembly.
Figure 7:
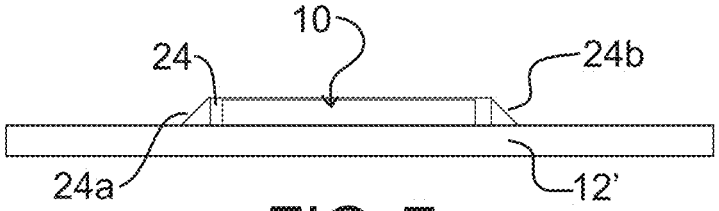
FIG. 7 is a side view illustrating the second embodiment of the headband of the head-mounted impact sensing and warning device, wherein a pocket is provided externally on the front layer of the headband and the front of the pocket comprises an aperture for exposing a front portion of the impact sensing and warning assembly.
Figure 8:
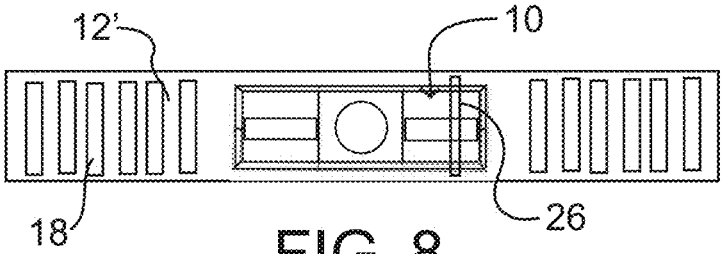
FIG. 8 is a front view illustrating the second embodiment of the headband of the head-mounted impact sensing and warning device, wherein the first embodiment of the impact sensing and warning assembly is disposed within the pocket of the headband behind the aperture.

Now, with reference to FIGS. 6-8, a second embodiment of the headband 12' will be explained. Like the first embodiment of the headband 12, the headband 12' also comprises a two-layered construction. However, the headband 12' is provided with a different means for receiving the impact sensing and warning assembly 10. In particular, as shown in FIGS. 6-8, the headband 12' is provided with a stitched pocket 24 disposed externally on its front (outer) layer. The impact sensing and warning assembly 10 is received within the pocket 24 of the headband 12' and is situated between the first and second longitudinal ends 24*a*, 24*b* of the pocket 24. The pocket 24 is provided with an elongated slit 26 disposed in the front outer surface thereof so as to permit the impact sensing and warning assembly 10 to be inserted into the pocket 24. In addition, as best illustrated in FIG. 6, the front outer surface of the pocket 24 is provided with an aperture (i.e., a rectangular aperture) disposed therethrough so that the electronic components of the impact sensing and warning assembly 10 are visible from outside of the pocket 24 (i.e., similar to the aperture 20 in the first embodiment of the headband 12).

Figure 9:
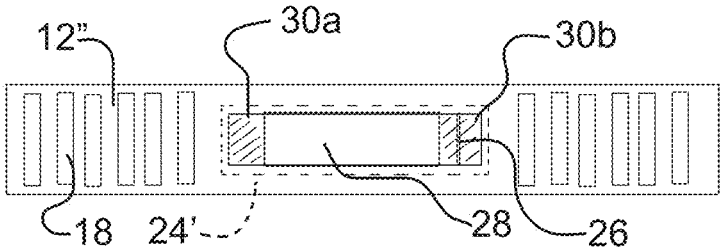
FIG. 9 is a front view illustrating a third embodiment of the headband of the head-mounted impact sensing and warning device, wherein a pocket is provided externally on the front layer of the headband and the front of the pocket comprises a transparent covering for protecting the impact sensing and warning assembly.
Figure 10:
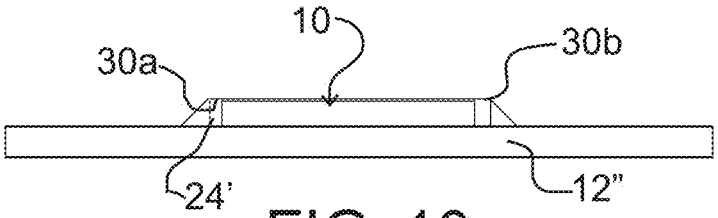
FIG. 10 is a side view illustrating the third embodiment of the headband of the head-mounted impact sensing and warning device, wherein a pocket is provided externally on the front layer of the headband and the front of the pocket comprises a transparent covering for protecting the impact sensing and warning assembly.
Figure 11:
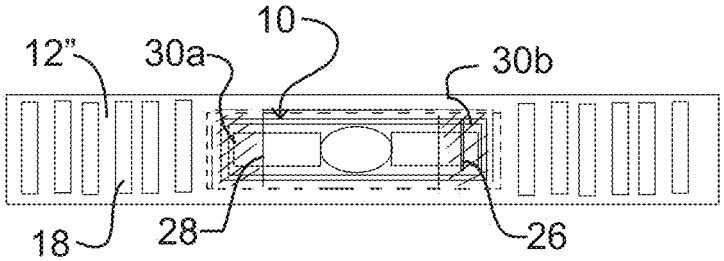
FIG. 11 is a front view illustrating the third embodiment of the headband of the head-mounted impact sensing and warning device, wherein the impact sensing and warning assembly is disposed within the pocket of the headband behind the transparent covering.

Next, referring to FIGS. 9-11, a third embodiment of the headband 12" will be described. The headband 12" is similar in some respects to the headband 12' Like the headband 12', the headband 12" is also provided with a stitched pocket 24' disposed externally on its front (outer) layer. However, the pocket 24' of the headband 12" has different features than the pocket 24 of the headband 12'. In particular, rather than being provided with an aperture (i.e., a rectangular aperture) in the front outer surface thereof for exposing the electronic components of the impact sensing and warning assembly 10, the pocket 24' is provided with a transparent outer cover portion 28 (e.g., a clear plastic covering) for permitting the electronic components of the impact sensing and warning assembly 10 to be readily visible Like the pocket 24 of the headband 12', the pocket 24' of the headband 12" is provided with an elongated slit 26 disposed in the front outer surface thereof (e.g., through the transparent outer cover portion 28) so as to permit the impact sensing and warning assembly 10 to be inserted into the pocket 24'. Also, similar to the second embodiment of the headband 12', the impact sensing and warning assembly 10 is received within the pocket 24' of the headband 12" and is situated between first and second longitudinal ends 30*a*, 30*b* of the pocket 24'.

Figure 12:
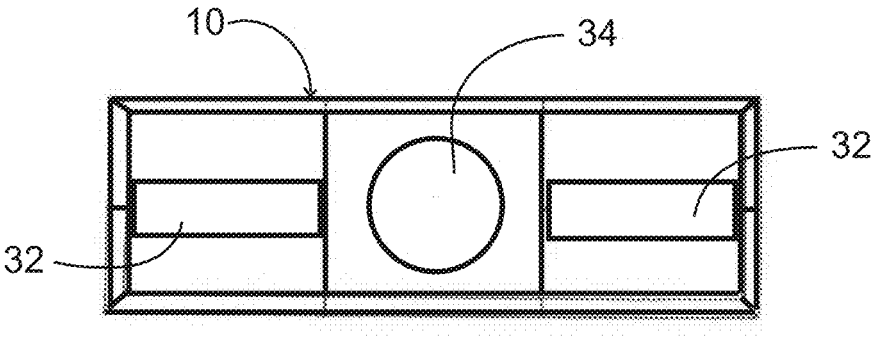
FIG. 12 is a front view illustrating a first embodiment of the impact sensing and warning assembly of the head-mounted impact sensing and warning device, wherein the impact sensing and warning assembly comprises electronic components.
Figure 14:
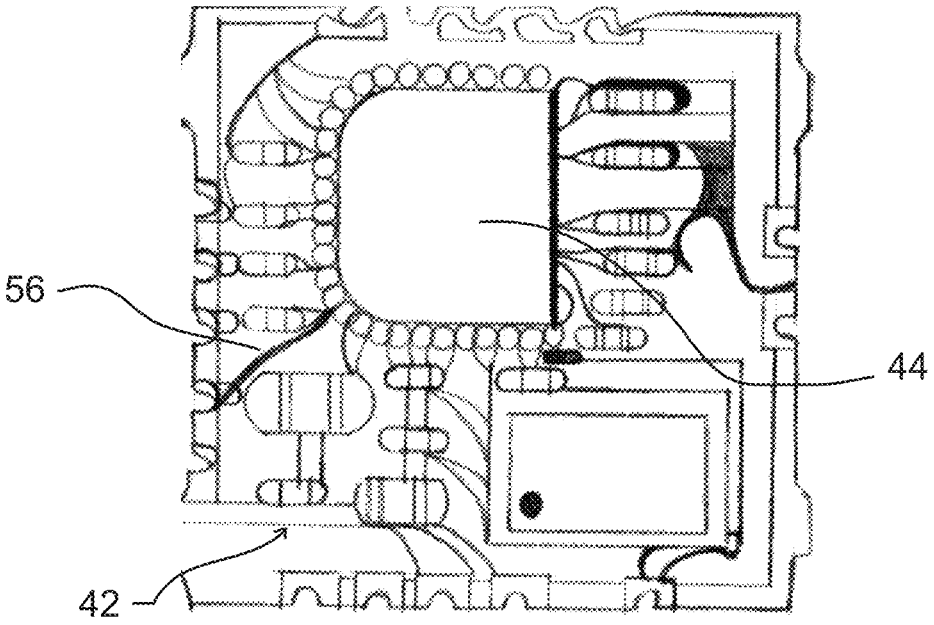
FIG. 14 is a front view illustrating an accelerometer and circuit board subassembly utilized in the first embodiment of the impact sensing and warning assembly, wherein the impact sensing and warning assembly comprises electronic components.

A first embodiment of the impact sensing and warning assembly is seen generally at 10 in FIG. 12. As illustrated in this figure, the impact sensing and warning assembly 10 generally comprises two visual indicating devices in the form of light emitting devices 32 (e.g., LEDs) and a reset button or device 34 for resetting the impact sensing and warning assembly 10 after it has been activated. The impact sensing and warning assembly 10 also comprises an impact sensing device in the form of an accelerometer and circuit board subassembly 42 (see FIG. 14). As shown in FIG. 14, the accelerometer and circuit board subassembly 42 comprises an accelerometer chip 44 that is electrically connected to, and mounted on, a printed circuit board (PCB) 56. Preferably, the accelerometer and circuit board subassembly 42 is disposed behind the light emitting devices 32 and the reset button or device 34 of the impact sensing and warning assembly 10 in its assembled state. In some embodiments, the impact sensing and warning assembly 10 is provided with a small microprocessor for processing the acceleration data sensed by the accelerometer chip 44.

Figure 18:
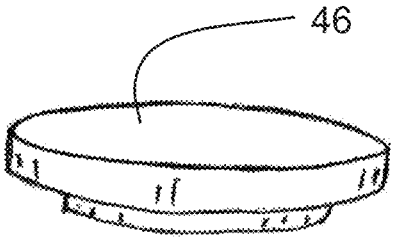
FIG. 18 is a perspective view illustrating a battery utilized in the first embodiment of the impact sensing and warning assembly, wherein the impact sensing and warning assembly comprises electronic components.

In the illustrated embodiment of the impact sensing and warning assembly 10, the light emitting devices 32 and the accelerometer and circuit board subassembly 42 are powered by a small battery. More particularly, as shown in FIG. 18, the electrical components of the impact sensing and warning assembly 10 are powered by a small, disk-like battery 46, such as a button cell battery.

Figure 15:
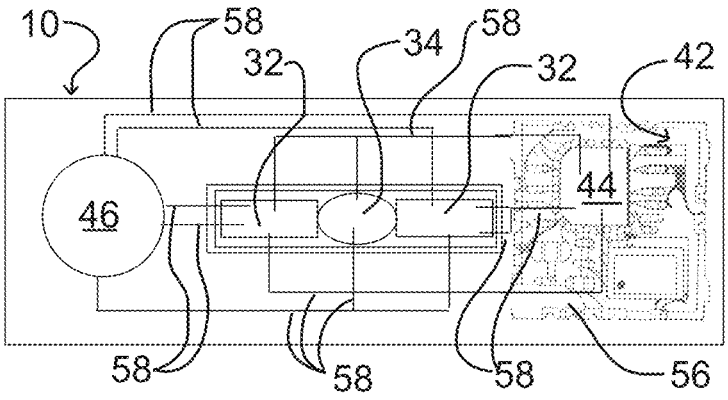
FIG. 15 is a diagrammatic view illustrating the electrical circuiting of the first embodiment of the impact sensing and warning assembly.

The electrical circuiting of the impact sensing and warning assembly 10 is diagrammatically illustrated in FIG. 15. With reference to this figure, it can be seen that the accelerometer chip 44 and the printed circuit board 56 of the accelerometer and circuit board subassembly 42 is electrically connected to the battery 46 by means of a plurality of electrical wires (conductors) 58. Similarly, each of the two light emitting devices 32 and the reset button or device 34 is electrically coupled to the battery 46 by means of a plurality of electrical wires 58. As such, the battery 46 supplies power to each of these electronic components 32, 34, 44, 56.

The reset device 34 of the impact sensing and warning assembly 10 allows the assembly 10 to be reset back to its original setting after the light emitting devices 32 have emitted visual indicators (i.e., one or more beams of light) in response to the accelerometer and circuit board subassembly 42 sensing an acceleration exceeding a predetermined acceleration value (or an impact exceeding a certain predetermined impact level). For example, when an acceleration is sensed that exceeds the predetermined acceleration value (e.g., 95 g's of force), the light emitting devices 32 will be turned "on" and begin flashing in order to alert individuals who are observing the user 16 of the device 10 (e.g., coaches, teammates, or spectators) that the user 16 may have sustained an impact to his or her head or helmeted area that exceeded the predetermined acceleration value (i.e., an indicator of a potential traumatic brain injury (TBI) or concussion). Once the predetermined impact level has been reached or exceeded, the microprocessor activates the light emitting devices (LEDs) 32 to blink continually for a predetermined time period (e.g., 300 seconds or 5 minutes). Once the predetermined time limit is reached, the microprocessor resets the reset device 34 back to its original setting so that the impact device may be used again. In other embodiments, the impact sensing and warning assembly 10 could be provided with non-volatile memory for storing previously sensed acceleration values therein (e.g., as part of the microcontroller 60 described hereinafter).

Figure 13:
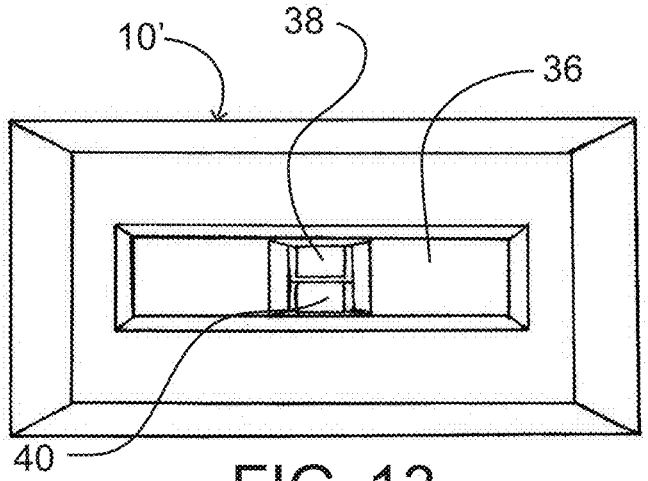
FIG. 13 is a front view illustrating a second embodiment of the impact sensing and warning assembly of the head-mounted impact sensing and warning device, wherein the impact sensing and warning assembly comprises one or more liquid-filled tubes.

A second embodiment of the impact sensing and warning assembly is seen generally at 10' in FIG. 13. As depicted in this figure, the impact sensing and warning assembly 10' generally comprises a liquid sensor subassembly 36, which has a first liquid-filled tube 38 and a second liquid-filled tube 40 disposed within a housing or enclosure. In this embodiment of the impact sensing and warning assembly, the first and second liquid-filled tubes 38, 40 each serve a combined function as both an impact sensing device and a visual indicating device. Namely, when an impact exceeding a certain predetermined impact level is sensed by the liquid-filled tubes 38, 40, at least a portion of the liquid disposed in the liquid-filled tubes 38, 40 is configured to change color (e.g., the liquid changes from a generally clear or transparent color to a red or blue color).

More particularly, in one embodiment of the impact sensing and warning assembly 10', one liquid portion of a multi-component liquid in each liquid-filled tube 38, 40 comprises a clear or transparent liquid and another liquid portion of the multi-component liquid in each liquid-filled tube 38, 40 comprises a colored dye. The colored dye is held in suspension with respect to the clear or transparent liquid such that, when the liquid-filled tube 38, 40 is subjected to an impact that exceeds an predetermined impact level, the impact disrupts the surface tension of the colored dye, thereby dispersing the colored dye along an axial length of the liquid-filled tube 38, 40 so as to provide a visual alert that the impact sustained by the head or the helmeted area of the user 16 exceeded the predetermined impact level.

Figure 16:
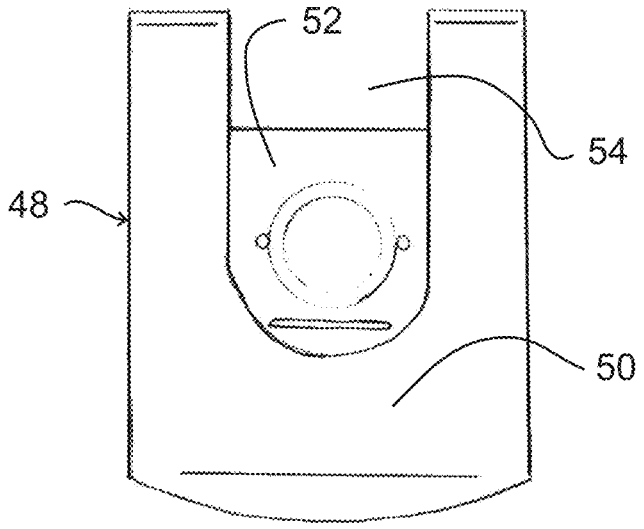
FIG. 16 is a front view of a clipping mechanism that is used for attaching various embodiments of the impact sensing and warning assembly to the band of the head-mounted impact sensing and warning device.
Figure 17:
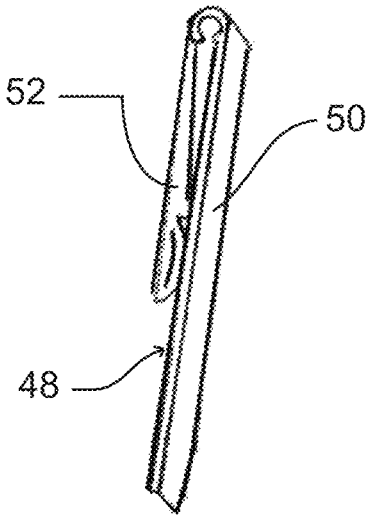
FIG. 17 is a side view of a clipping mechanism that is used for attaching various embodiments of the impact sensing and warning assembly to the band of the head-mounted impact sensing and warning device.

A clipping mechanism 48 that is used to secure the impact sensing and warning assemblies 10, 10' to the headband or strap 12 of the head-mounted impact sensing and warning device is illustrated in FIGS. 16 and 17. With reference to these figures, it can be seen that the clipping mechanism 48 generally comprises a first clip member 50 that is attached to a second clip member 52 by flexible hinges at their respective upper edges. As best shown in FIG. 16, the first clip member 50 is U-shaped with an aperture 54 disposed in the upper portion thereof.

In one embodiment, the clipping mechanism 48 is formed from a resilient polymer or silicone material (i.e., a resilient plastic) so that the first and second clip members 50, 52 are capable of being displaced with respect to one another (e.g., the second clip member 52 can be rotated about the flexible hinges located at the top of the clipping mechanism 48 so that the clipping mechanism can be attached to a headband 12). As such, the resilient polymer or silicone construction of the clipping mechanism 48 would allow the first and second clip members 50, 52 to be elastically deformed as needed for attachment to various objects.

Figure 21:
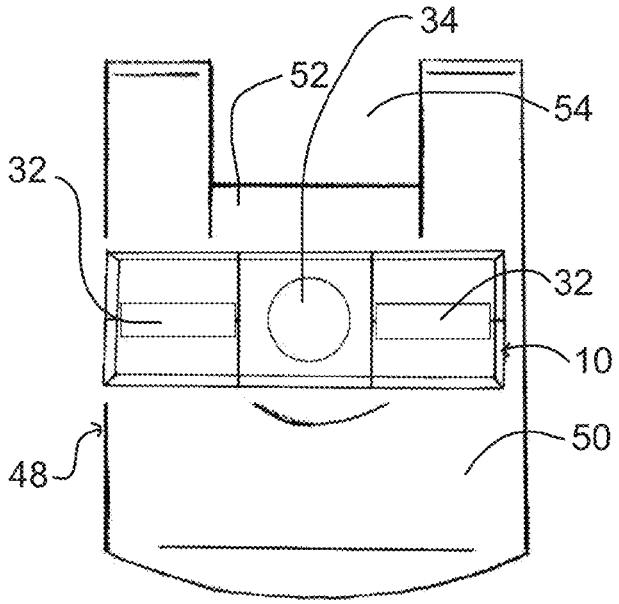
FIG. 21 is a front view illustrating the first embodiment of the impact sensing and warning assembly, which comprises electronic components, attached to a clipping mechanism.
Figure 23:
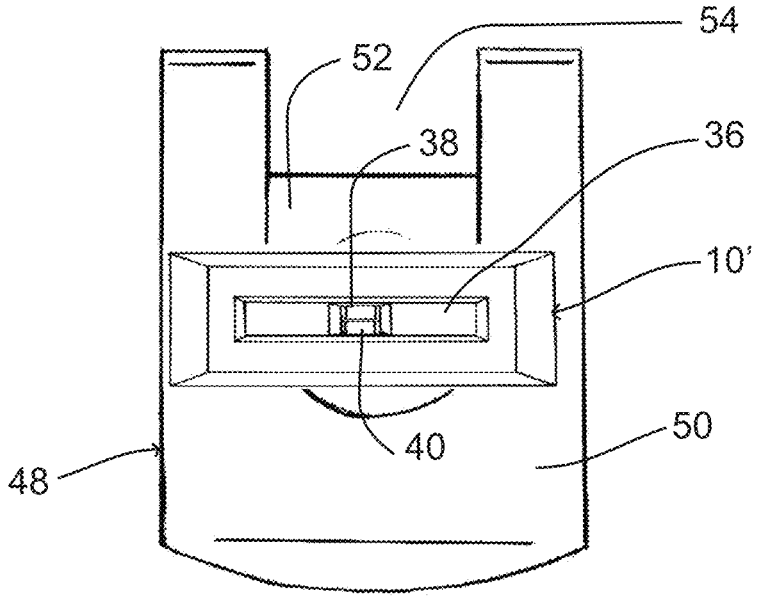
FIG. 23 is a front view illustrating the second embodiment of the impact sensing and warning assembly, which comprises one or more liquid-filled tubes, attached to a clipping mechanism.

In FIG. 21, the impact sensing and warning assembly 10 is shown attached to the first clip member 50 of the clipping mechanism 48. Similarly, in FIG. 23, the impact sensing and warning assembly 10' is shown attached to the first clip member 50 of the clipping mechanism 48. Those of ordinary skill in the art will appreciate that the impact sensing and warning assemblies 10, 10' can be secured to the clipping mechanism using various suitable means such as, but not limited to, adhesives and fasteners.

Figure 22:
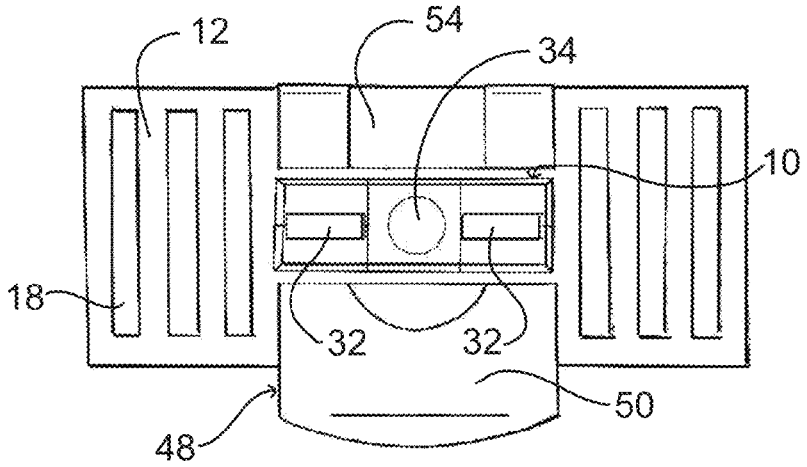
FIG. 22 is a front view illustrating the first embodiment of the impact sensing and warning assembly, which comprises electronic components, attached to a headband by means of a clipping mechanism.
Figure 24:
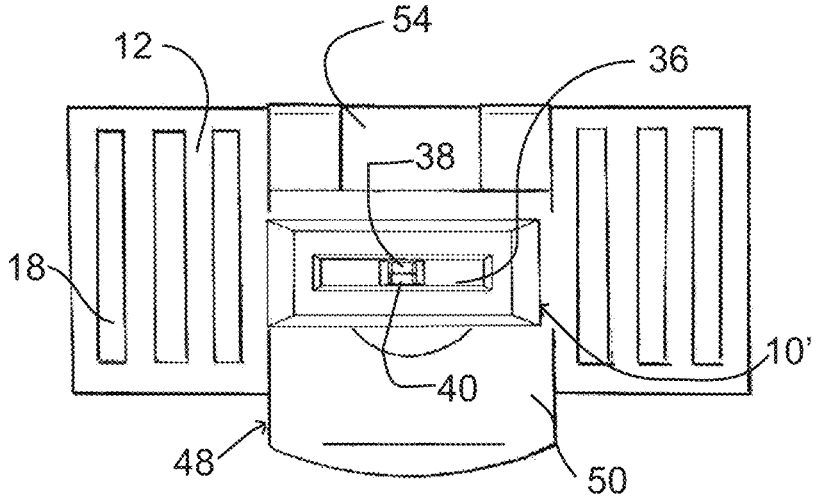
FIG. 24 is a front view illustrating the second embodiment of the impact sensing and warning assembly, which comprises one or more liquid-filled tubes, attached to a headband by means of a clipping mechanism.

Referring to FIG. 22, it can be seen that the clipping mechanism 48 can be used to removably attach the impact sensing and warning assembly 10 to a headband 12. Similarly, FIG. 24 illustrates the manner in which the clipping mechanism 48 can be used to removably attach the impact sensing and warning assembly 10' to a headband 12. Advantageously, the clipping mechanism 48 allows the impact sensing and warning assemblies 10, 10' to be attached to various headbands, bandanas or straps securing glasses or goggles, thereby enabling a user 16 to utilize the impact sensing and warning assemblies 10, 10' on conventional headbands and straps. The clipping mechanism 48 also enables the impact sensing and warning assemblies 10, 10' to be transferred between various headbands, bandanas or straps securing glasses or goggles (e.g., for use in different sports by the user 16).

Figure 19:
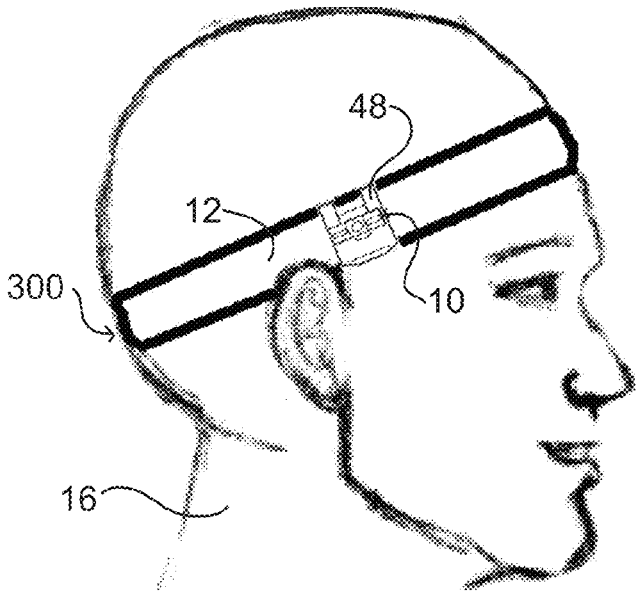
FIG. 19 is a side view of a head/skull of a user with a head-mounted impact sensing and warning device disposed around the forehead and back of the head/skull according to a third embodiment of the invention, wherein the band of the device is in the form of a headband and an impact sensing and warning assembly comprising electronic components is attached to the headband by means of a clipping mechanism.
Figure 20:
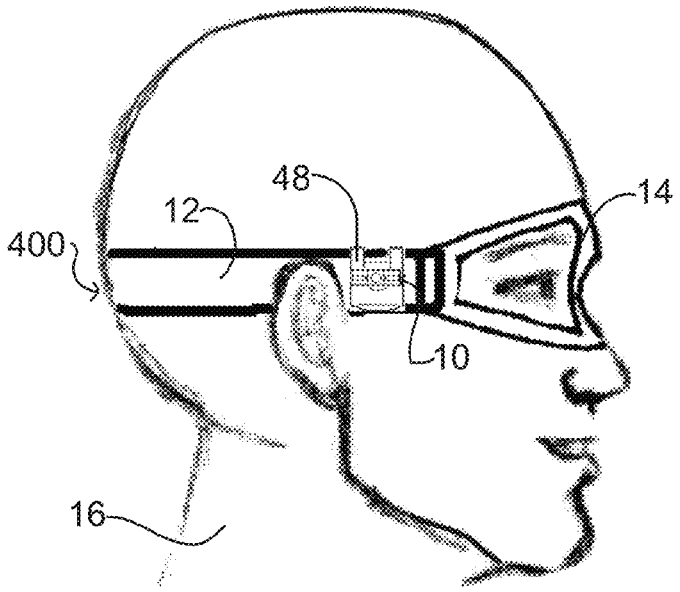
FIG. 20 is a side view of a head/skull of a user with a head-mounted impact sensing and warning device disposed around the back and side of the head/skull according to a fourth embodiment of the invention, wherein the band of the device is in the form of a strap for securing glasses or goggles and the impact sensing and warning assembly comprising electronic components is attached to the strap by means of a clipping mechanism.

A third embodiment of the head-mounted impact sensing and warning device is seen generally at 300 in FIG. 19. As shown in this figure, the clipping mechanism 48 is used to attach the impact sensing and warning assembly 10 to the headband 12 disposed around the head of a user 16. In FIG. 20, a fourth embodiment of the head-mounted impact sensing and warning device is seen generally at 400. In this illustrated embodiment, the clipping mechanism 48 is used to attach the impact sensing and warning assembly 10 to a band that is in the form of a strap 12 for securing glasses or sports goggles 14 to the head of a user 16.

Figure 25:
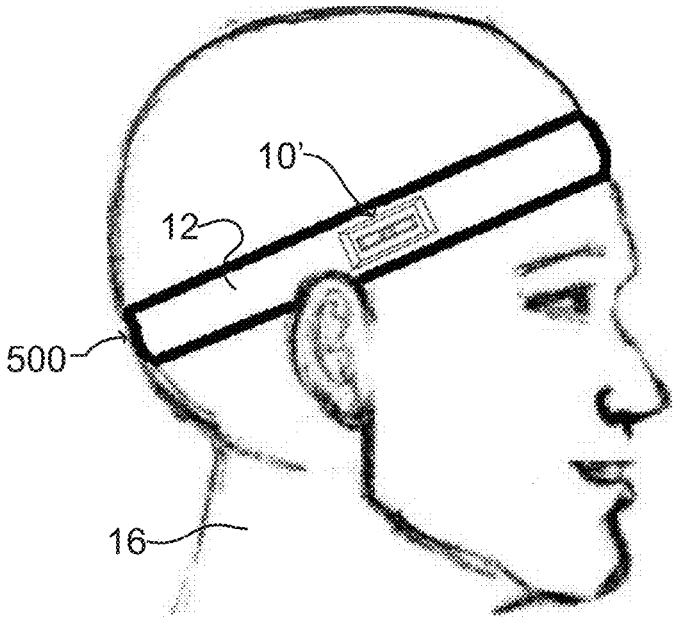
FIG. 25 is a side view of a head/skull of a user with a head-mounted impact sensing and warning device disposed around the forehead and back of the head/skull according to a fifth embodiment of the invention, wherein the band of the device is in the form of a headband and the impact sensing and warning assembly comprises one or more liquid-filled tubes.
Figure 26:
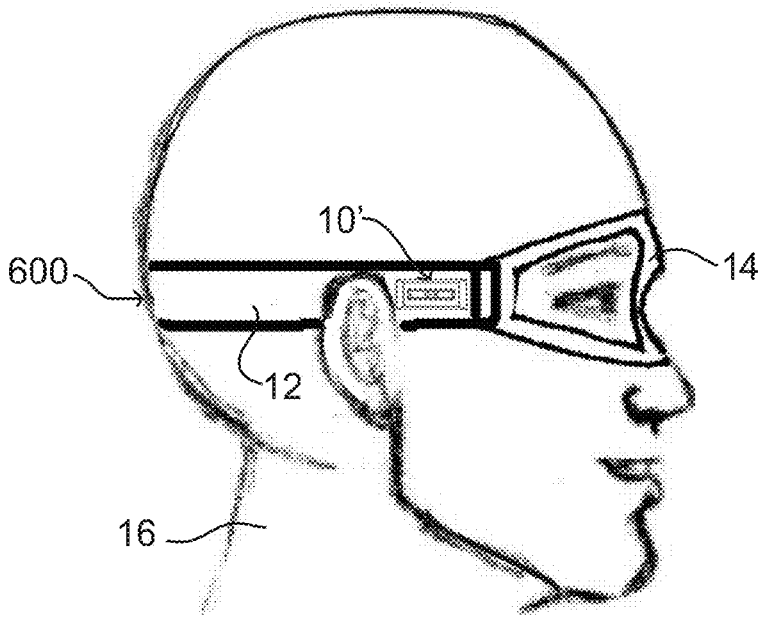
FIG. 26 is a side view of a head/skull of a user with a head-mounted impact sensing and warning device disposed around the back and side of the head/skull according to a sixth embodiment of the invention, wherein the band of the device is in the form of a strap for securing glasses or goggles and the impact sensing and warning assembly comprises one or more liquid-filled tubes.

A fifth embodiment of the head-mounted impact sensing and warning device is seen generally at 500 in FIG. 25. As shown in this figure, the impact sensing and warning assembly 10' comprising liquid-filled tubes is attached to a headband 12 disposed around the head of a user 16. In FIG. 26, a sixth embodiment of the head-mounted impact sensing and warning device is seen generally at 600. In this illustrated embodiment, the impact sensing and warning assembly 10' comprising liquid-filled tubes is attached to a band that is in the form of a strap 12 for securing glasses or sports goggles 14 to the head of a user 16.

Figure 27:
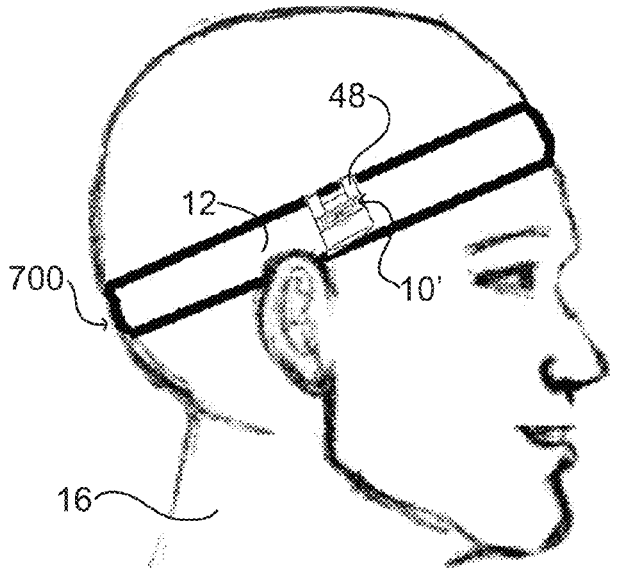
FIG. 27 is a side view of a head/skull of a user with a head-mounted impact sensing and warning device disposed around the forehead and back of the head/skull according to a seventh embodiment of the invention, wherein the band of the device is in the form of a headband and an impact sensing and warning assembly comprising one or more liquid-filled tubes is attached to the headband by means of a clipping mechanism.
Figure 28:
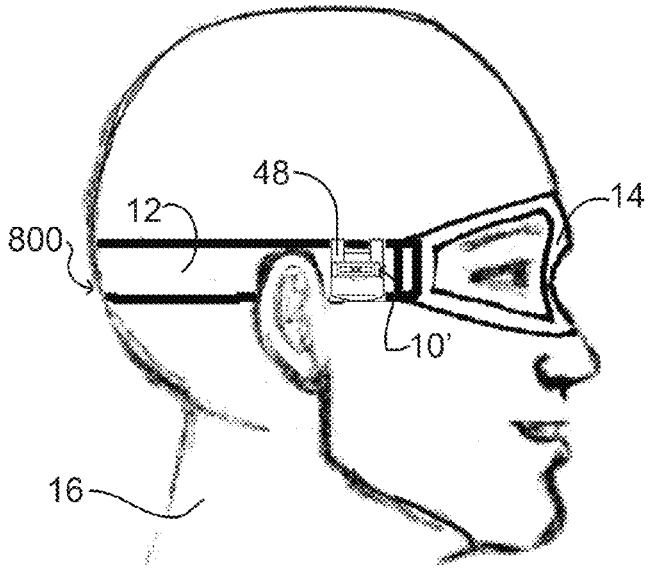
FIG. 28 is a side view of a head/skull of a user with a head-mounted impact sensing and warning device disposed around the back and side of the head/skull according to an eighth embodiment of the invention, wherein the band of the device is in the form of a strap for securing glasses or goggles and the impact sensing and warning assembly comprising one or more liquid-filled tubes is attached to the strap by means of a clipping mechanism.

Seventh and eighth illustrative embodiments 700, 800 of the head-mounted impact sensing and warning device are depicted in FIGS. 27 and 28, respectively. Head-mounted impact sensing and warning devices 700, 800 are generally similar to the head-mounted impact sensing and warning devices 300, 400 of FIGS. 19 and 20, except that impact sensing and warning assemblies 10' comprising liquid-filled tubes are used in illustrated embodiments of FIGS. 27 and 28, while impact sensing and warning assemblies 10 comprising electronic components are utilized in FIGS. 19 and 20.

Figure 29:
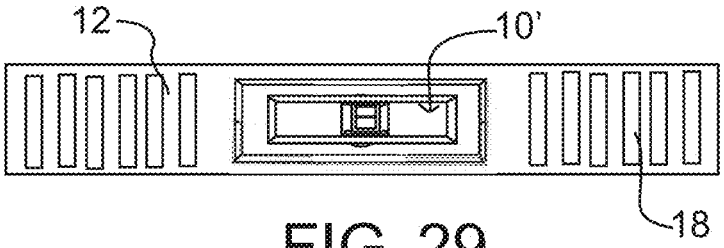
FIG. 29 is a front view illustrating a first embodiment of the headband of the head-mounted impact sensing and warning device, wherein the headband is in the form of a two-layer headband and the back layer of the headband is depicted with the second embodiment of the impact sensing and warning assembly attached thereto.
Figure 30:
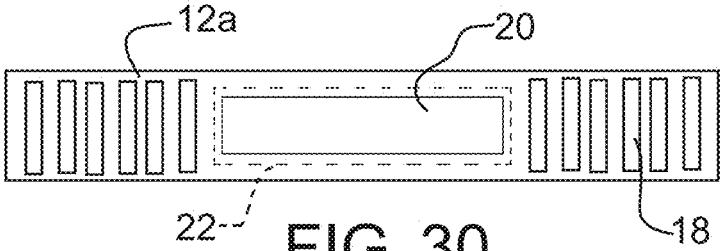
FIG. 30 is a front view illustrating the first embodiment of the headband of the head-mounted impact sensing and warning device, wherein the front layer of the headband is depicted.
Figure 31:
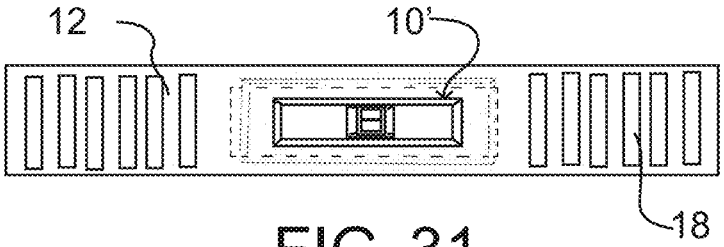
FIG. 31 is a front view illustrating the first embodiment of the headband of the head-mounted impact sensing and warning device, wherein both layers of the headband are depicted with the second embodiment of the impact sensing and warning assembly sandwiched therebetween.
Figure 32:
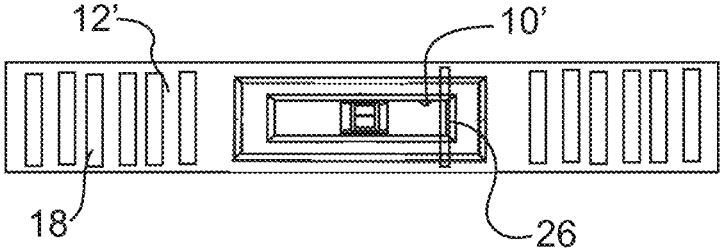
FIG. 32 is a front view illustrating the second embodiment of the headband of the head-mounted impact sensing and warning device, wherein the second embodiment of the impact sensing and warning assembly is disposed within the pocket of the headband behind the aperture.
Figure 33:
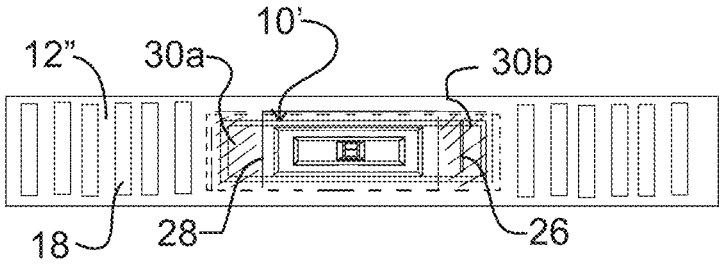
FIG. 33 is a front view illustrating the third embodiment of the headband of the head-mounted impact sensing and warning device, wherein the second embodiment of the impact sensing and warning assembly is disposed within the pocket of the headband behind the transparent covering.

The construction of the headband 12 shown in FIGS. 29-31 is the same as the construction of the headband illustrated in FIGS. 3-5. However, in FIGS. 29-31, an impact sensing and warning assembly 10' comprising liquid-filled tubes is attached to the headband 12, rather than the impact sensing and warning assembly 10 comprising electronic components, as in FIGS. 3-5. Moreover, the construction of the headband 12' shown in FIG. 32 is the same as the construction of the headband illustrated in FIG. 8. The only difference between the two figures being that an impact sensing and warning assembly 10' comprising liquid-filled tubes is attached to the headband 12' of FIG. 32, while an impact sensing and warning assembly 10 comprising electronic components is attached to the headband 12' of FIG. 8. Furthermore, the construction of the headband 12" shown in FIG. 33 is the same as the construction of the headband illustrated in FIG. 11. The only difference between the two figures being that an impact sensing and warning assembly 10' comprising liquid-filled tubes is attached to the headband 12" of FIG. 33, while an impact sensing and warning assembly 10 comprising electronic components is attached to the headband 12" of FIG. 11.

Figure 39:
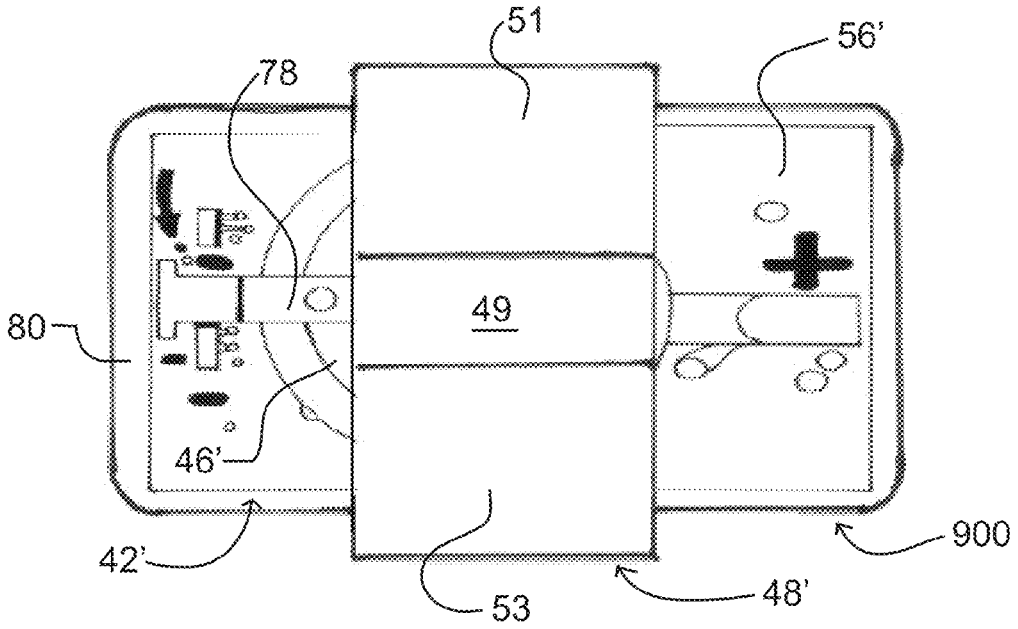
FIG. 39 is a diagrammatic rear view illustrating the ninth embodiment of the impact sensing and warning device, wherein a clipping mechanism is provided on the rear of the housing unit that contains the electrical circuit board of the assembly.
Figure 40:
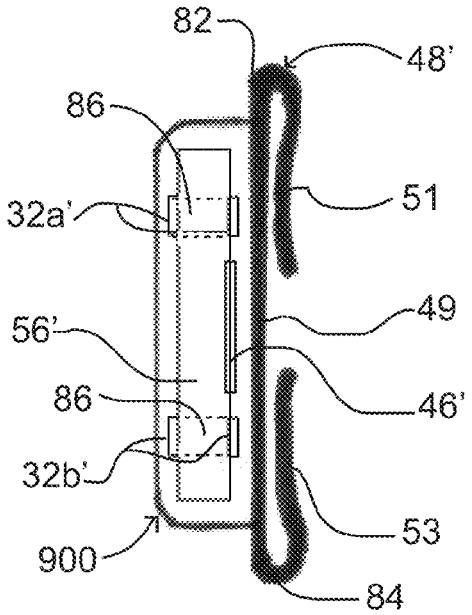
FIG. 40 is a diagrammatic end view of the impact sensing and warning device of FIG. 39.

A ninth illustrative embodiment of the head-mounted impact sensing and warning device is seen generally at 900 in FIGS. 39 and 40. Referring to these figures, it can be seen that, in many respects, the ninth illustrative embodiment is similar to several of the preceding embodiments described above. Moreover, many elements are common to these embodiments. For the sake of brevity, the elements that the ninth embodiment of the head-mounted impact sensing and warning device has in common with the similar preceding embodiments will only be briefly discussed, if at all, because these components have already been explained in detail above. Furthermore, in the interest of clarity, these elements are denoted using reference characters that are similar to those used above in the preceding embodiments.

With initial reference to FIGS. 39 and 40, the ninth embodiment of the head-mounted impact sensing and warning device 900 will be described. As shown in these figures, the head-mounted impact sensing and warning device 900 generally comprises a circuit board subassembly 42' disposed within a substantially transparent housing 80 and a clipping mechanism 48' attached to the rear wall of the housing 80. By using the clipping mechanism 48', the housing 80 of the head-mounted impact sensing and warning device 900 may be attached to various headbands, bandanas or straps securing glasses or goggles worn on the head of a user.

Figure 34:
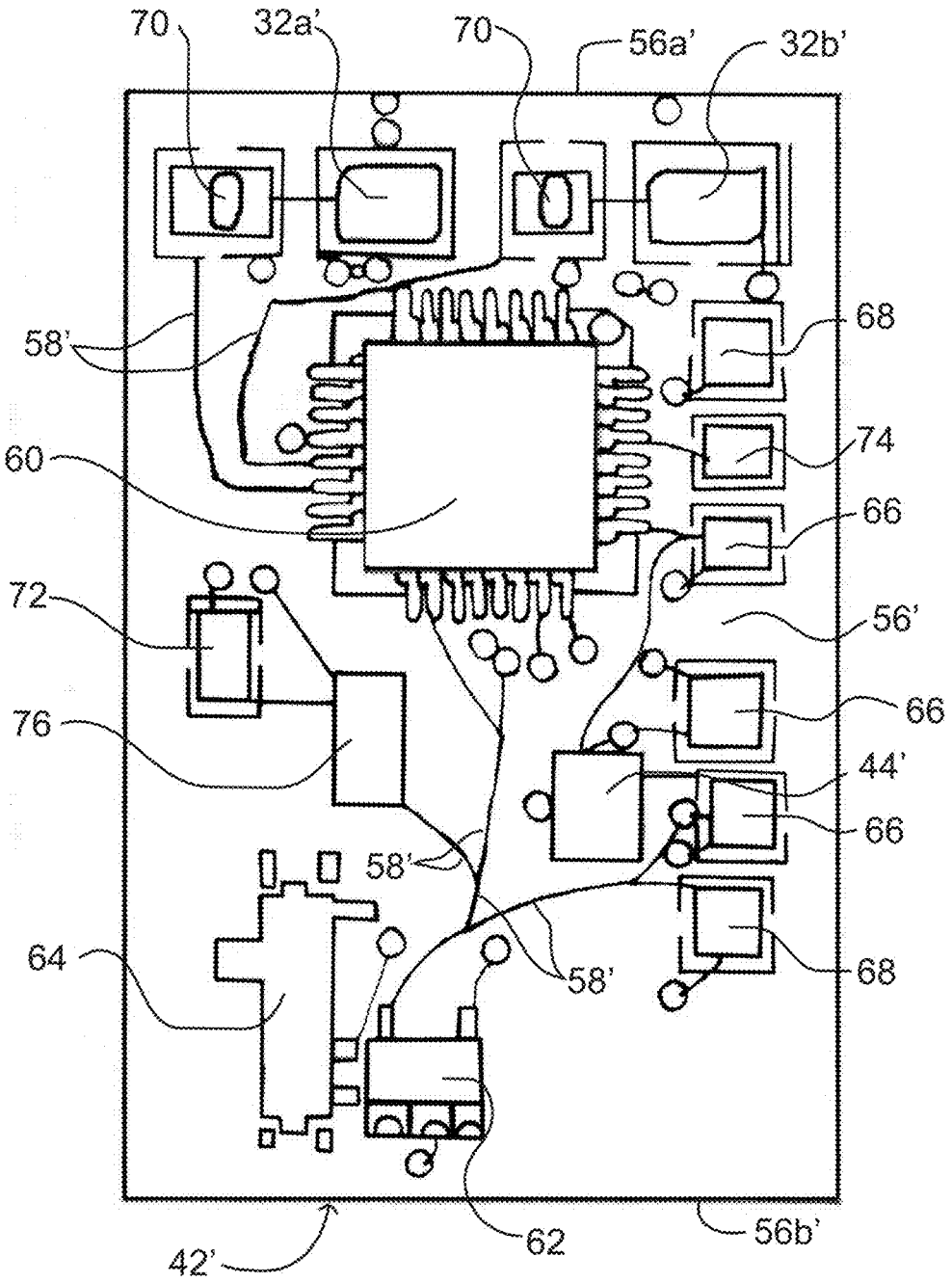
FIG. 34 is a diagrammatic front view illustrating the electrical circuiting of another embodiment of the impact sensing and warning assembly, wherein the electrical circuit board of the assembly in FIG. 34 is provided with two light emitting devices.
Figure 36:
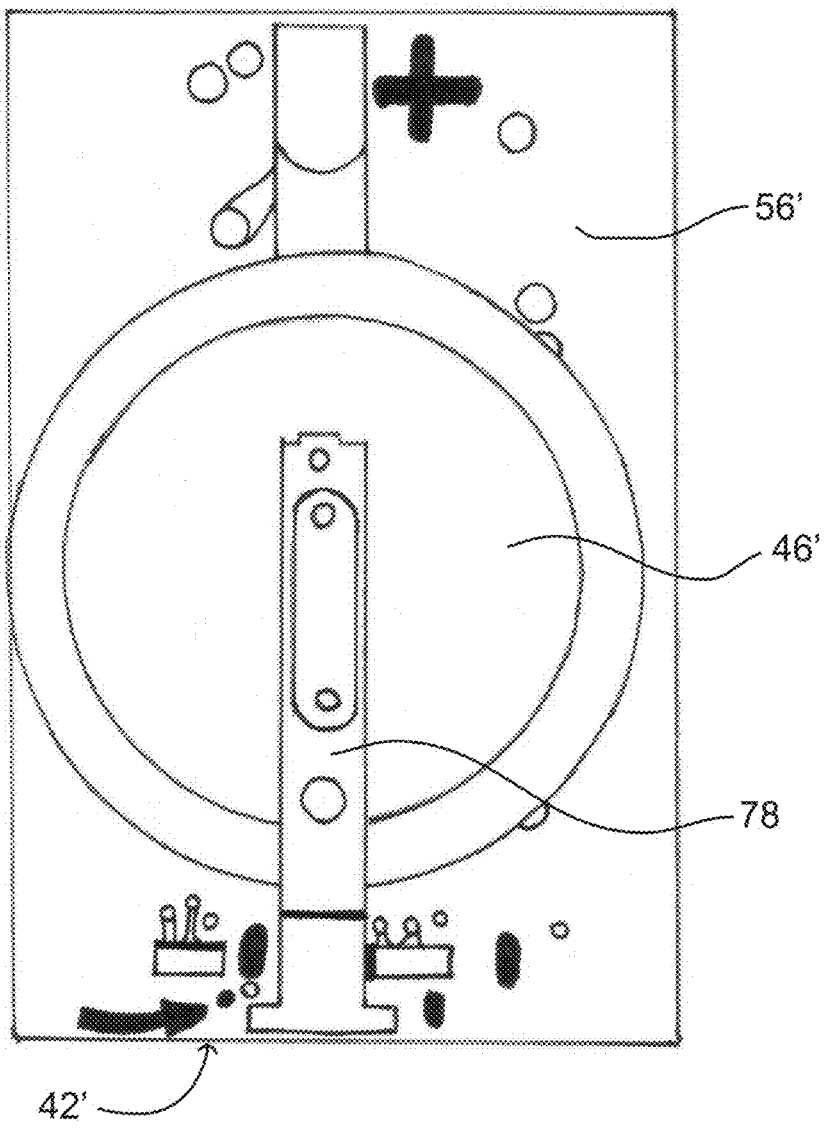
FIG. 36 is a diagrammatic rear view of the electrical circuit board of FIG. 34.

Now, with reference to FIGS. 34 and 36, the circuit board subassembly 42' of the head-mounted impact sensing and warning device 900 will be explained in detail. The electrical circuiting of the impact sensing and warning assembly is diagrammatically illustrated in FIGS. 34 and 36. With reference to these figures, it can be seen that the circuit board subassembly 42' includes an accelerometer 44', a microcontroller 60, a plurality of light emitting devices 32*a*', 32*b*', and a button cell battery 46' operatively coupled to a printed circuit board (PCB) 56'. As shown in FIGS. 34 and 36, the components 32*a*', 32*b*', 44', 46', 60 of the circuit board subassembly 42' are electrically connected together in an operative manner via the electrically conductive traces or wires 58' that are integrated in the printed circuit board (PCB) 56' (i.e., conductive copper tracks integrated in the PCB 56'). In particular, the accelerometer 44', the microcontroller 60, and the plurality of light emitting devices 32*a*', 32*b*' are all electrically connected to the button cell battery 46' by means of the electrically conductive traces 58' on the PCB 56' so that the button cell battery 46' is capable of powering each of these components 32*a*', 32*b*', 44', 60.

Similar to that described above with regard to the preceding embodiments, accelerometer 44' of the circuit board subassembly 42' senses an acceleration sustained by a head or helmeted area of a user and outputs a signal comprising acceleration data to the microcontroller 60. The accelerometer 44' is capable of sensing accelerations sustained by the user that are within an acceleration range comprising impact accelerations for which a concussion may occur. In an exemplary embodiment, the accelerometer 44' may comprise a triaxial type accelerometer that is capable of measuring accelerations in the each of x, y, and z directions, and has an acceleration range between approximately −200 g forces and 200 g forces.

The microcontroller 60 selectively activates and deactivates the accelerometer 44' as needed (i.e., between active and inactive modes), and processes the acceleration data outputted by the accelerometer 44'. The microcontroller 60 also controls the operation of the light emitting devices 32*a*', 32*b*' of the head-mounted impact sensing and warning device 900. In an exemplary embodiment, the microcontroller 60 may comprise a core processor or microprocessor with a processing speed of at least 20 MHz, at least an 8-bit processor core size, a flash-type program memory with a size of at least 16 KB, and at least twenty (20) inputs and outputs. The inactive mode of the device 900 is used to conserve battery power so that the power provided by the battery 46' is only consumed when necessary to measure accelerations experienced by the user of the device 900.

As shown in the illustrative embodiment of FIG. 34, the plurality of light emitting devices comprise two (2) light-emitting diodes (LEDs) 32*a*', 32*b*' disposed proximate to a first end 56*a*' of the printed circuit board 56'. In FIG. 34, it can be seen that the light-emitting diodes 32*a*', 32*b*' are spaced apart from one another in the illustrated embodiment by another component on the board, such as a resistor 70. In an exemplary embodiment, the first light-emitting diode 32*a*' is a green LED that is surface-mounted on the PCB 56', while the second light-emitting diode 32*b*' is a red LED that is also surface-mounted on the PCB 56'. However, it is to be understood that other suitable light-emitting diodes may also be used for the head-mounted impact sensing and warning device 900, such as different-colored light emitting diodes.

Figure 35:
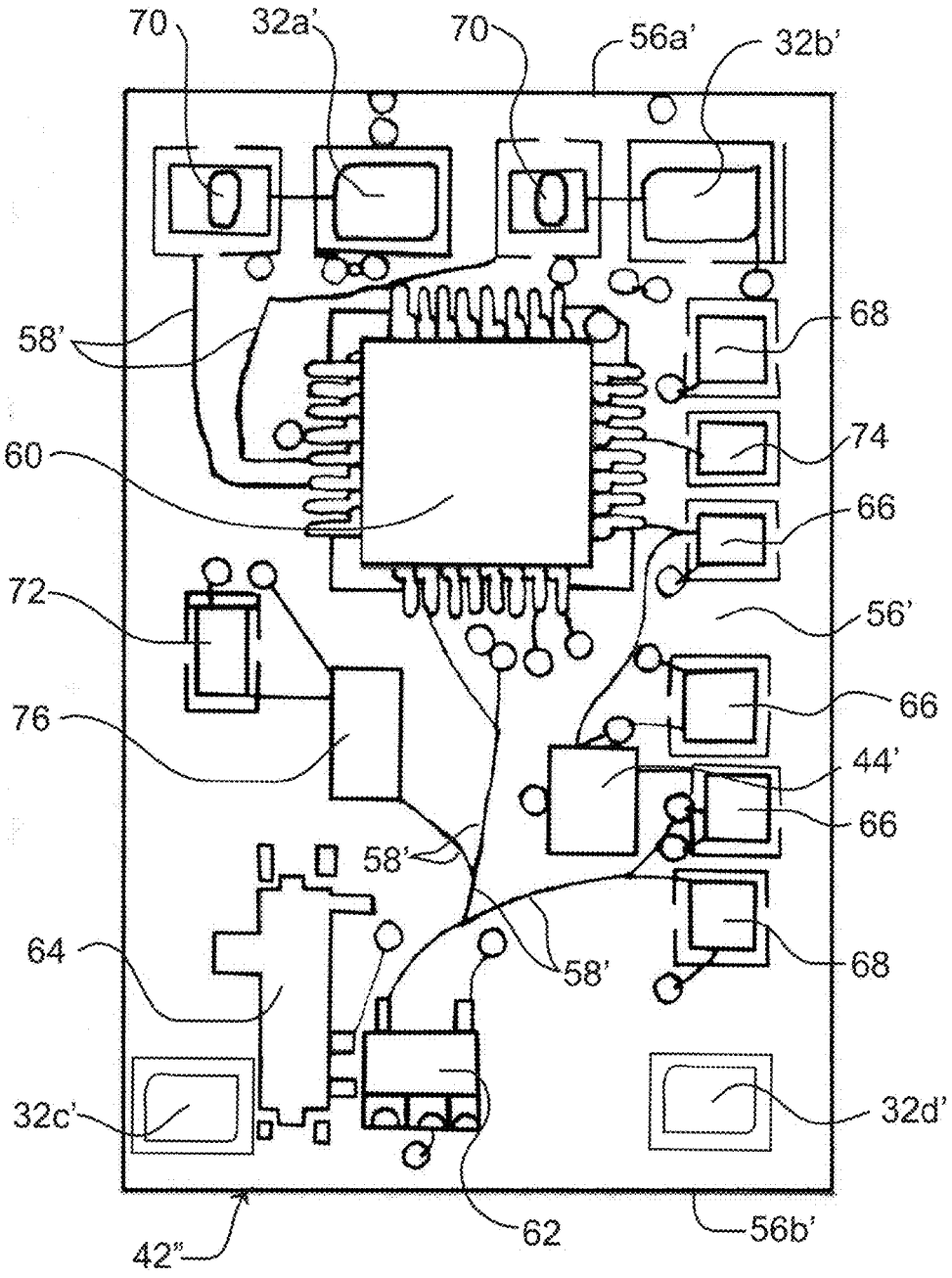
FIG. 35 is an alternative diagrammatic front view illustrating the electrical circuiting of the impact sensing and warning assembly, wherein the electrical circuit board of the assembly in FIG. 35 is provided with four light emitting devices rather than the two light emitting devices of FIG. 34.

Referring to FIG. 35, an alternative embodiment of the circuit board subassembly 42" is shown. The circuit board subassembly 42" of FIG. 35 is generally the same as the circuit board subassembly 42' of FIG. 34, except that four (4) light-emitting diodes (LEDs) 32*a*', 32*b*', 32*c*', 32*d*' are disposed on the printed circuit board 56', rather than the two (2) light-emitting diodes 32*a*', 32*b*' of FIG. 34. In particular, as in the embodiment of FIG. 34, two (2) light-emitting diodes 32*a*', 32*b*' are disposed proximate to the first end 56*a*' of the printed circuit board 56'. Although, unlike the embodiment of FIG. 34, two (2) additional light-emitting diodes 32*c*', 32*d*' are disposed proximate to the second end 56*b*' of the printed circuit board 56' so that the light emitted from the head-mounted impact sensing and warning device 900 is more readily visible (i.e., brighter) to third party individuals who are observing the wearer of the device 900. In an exemplary embodiment, the light-emitting diodes 32*a*' 32*c*' are green LEDs that are surface-mounted on the PCB 56', while the light-emitting diodes 32*b*', 32*d*' are red LEDs that are also surface-mounted on the PCB 56'. However, it is to be understood that other suitable light-emitting diodes may also be used for the head-mounted impact sensing and warning device 900, such as different-colored light emitting diodes.

As shown in the rear view of the circuit board subassembly 42' in FIG. 36, the button cell battery 46' is removably secured to the back of the printed circuit board (PCB) 56' by means of a battery clip 78. That is, the battery clip 78, which may be formed from an electrically conductive metallic material, is elastically deformable so as to securely hold the button cell battery 46' in place on the PCB 56'. The button cell battery 46' provides power for all of the electrical components of the head-mounted impact sensing and warning device 900, including the components 32*a*', 32*b*', 44', 60 described above and the additional electrical components of the device 900 that will be described hereinafter. In an exemplary embodiment, the button cell or coin-cell battery 46' may comprise a lithium-type battery with output voltage of approximately 3 volts (3V) and a current discharge rate of approximately 200 microamperes (200 μA).

Referring again to the front view of the circuit board subassembly 42' in FIG. 34, it can be seen that the circuit board subassembly 42' may further include a power regulator 62 that regulates the power that is delivered by the button cell battery 46' to the electrically powered components of the head-mounted impact sensing and warning device 900, including the components 32*a*', 32*b*', 44', 60 described above. In an exemplary embodiment, the power regulator 62 may comprise a power regulator with an input voltage of up to 5.5 volts, an output voltage of approximately 2.8 volts, and a current output of approximately 150 milliamperes (150 mA).

Turning to FIG. 34 again, it can be seen that the circuit board subassembly 42' may further comprise a power switch 64 which is fixed in the "on" position and cannot be turned off manually by a user. In an exemplary embodiment, the power switch 64 may have a voltage rating of approximately 4 volts and a current rating of approximately 300 milliamps (300 mA) direct current (DC).

Also, as shown in FIG. 34, the circuit board subassembly 42' may further include a first plurality of capacitors 66 (i.e., three (3) capacitors) operatively coupled to the accelerometer 44' for setting the respective bandwidths of the x, y, and z directions of the accelerometer 44' to a predetermined sampling frequency (e.g., 500 Hz). The bandwidth controls the amount of times per second that the accelerometer 44' takes a reliable acceleration reading in each of the three (3) orthogonal directions. In an exemplary embodiment, each of the first plurality of capacitors 66 may have a capacity of 10,000 picofarads (10,000 pF) or 0.01 microfarads (0.01 μF).

In addition, as shown in FIG. 34, the circuit board subassembly 42' may further include a second plurality of capacitors 68 (i.e., two (2) decoupling capacitors), each of which is operatively coupled to a respective one of the accelerometer 44' and the microcontroller 60 so as to decouple the supply voltage line and its reference (ground) for the components 44', 60. In an exemplary embodiment, each of the second plurality of capacitors 68 may have a capacity of 100,000 picofarads (100,000 pF) or 0.1 microfarads (0.1 μF).

Referring again to FIG. 34, it can be seen that the circuit board subassembly 42' may further include a plurality of resistors 70, 74, and 76. Each of the two (2) resistors 70 are electrically coupled to respective ones of the light-emitting diodes 32*a*', 32*b*' so as to prevent excessive current flow through the light-emitting diodes 32*a*', 32*b*' that may result in the light-emitting diodes 32*a*', 32*b*' overheating or burning. The resistor 72 is electrically coupled to the motion sensor 76 so as to limit the flow of current through the motion sensor 76. The resistor 74 is electrically coupled to the microcontroller 60, and functions as a pull-up resistor for the reset of the microcontroller 60. In an exemplary embodiment, each of the two (2) resistors 70 has a resistance rating of 100 ohms (100Ω), the resistor 72 has a resistance rating of 10 megaohms (10M Ω), and the resistor 74 has a resistance rating of 10 kilohms (10 k Ω).

Also, as illustrated in FIG. 34, the circuit board subassembly 42' may further include a motion sensor or tilt sensor 76 for sensing motion of the head-mounted impact sensing and warning device 900 so as to signal the microcontroller 60 to switch from its inactive mode to its active mode, wherein the accelerometer 44' is actively sensing accelerations experienced by the user wearing the device 900. Any movement imparted on the device 900 causes the motion sensor 76 to wake up the microcontroller 60 for a predetermined amount of time (e.g., 5 minutes). When the microcontroller 60 is awake (i.e., in the active mode), it turns on the accelerometer 44', which monitors any acceleration imparted on the user of the device 900. If and when the acceleration threshold is reached, the light-emitting diodes 32*a*', 32*b*' are activated. When the device 900 is stationary for a predetermined amount (e.g., 3 minutes), the microcontroller 60 enters the inactive mode or sleep mode in which the power of battery 46' is conserved. In an exemplary embodiment, the motion sensor 76 is configured for omnidirectional movement sensing and it chatters open or closed when tilted or vibrated in any direction regardless of orientation. Also, in the exemplary embodiment, the motion sensor 76 is normally closed at rest.

Figure 37:
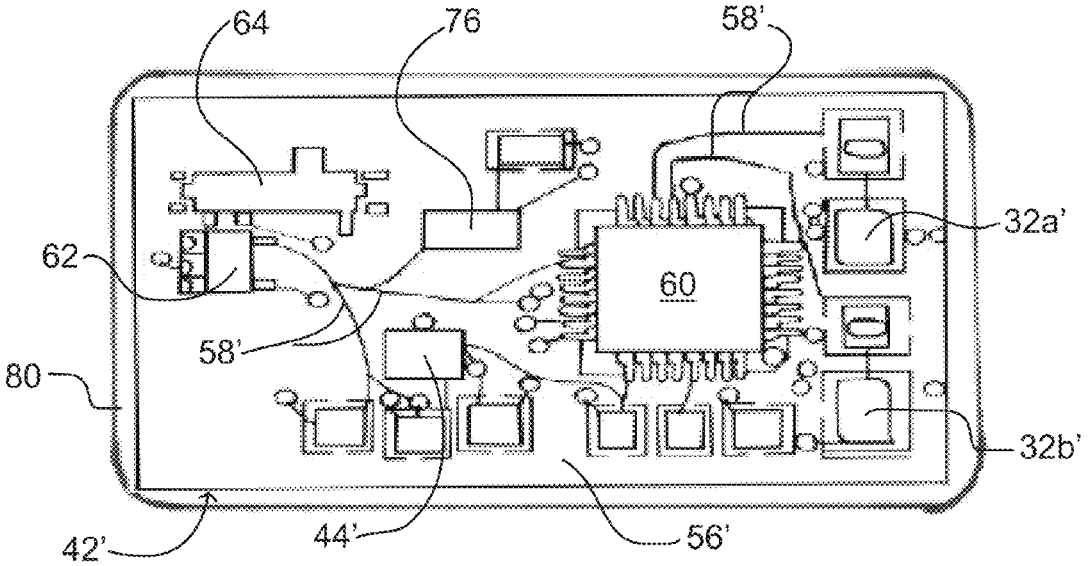
FIG. 37 is a diagrammatic front view of the electrical circuit board of FIG. 34 disposed within a housing unit.
Figure 38:
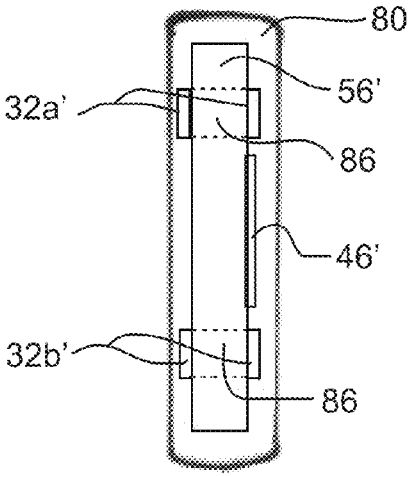
FIG. 38 is a diagrammatic end view of the electrical circuit board and housing unit of FIG. 37.

With reference to FIGS. 37 and 38, it can be seen that the substantially transparent housing 80 completely, or at least substantially, encloses the head-mounted impact sensing and warning device 900. Because the housing 80 is substantially transparent, the light emitted by the light-emitting diodes 32*a*', 32*b*', or by the light-emitting diodes 32*a*', 32*b*', 32*c*', 32*d*' (if four lights are used instead of two), is visible through the unit housing 80 to third party individual(s) that are observing the user of the device 900 during the sporting activity. As such, when the lights of light-emitting diodes 32*a*', 32*b*', 32*c*', 32*d*' shine through the unit housing 80, the third party observer(s) are aware that the impact sustained by the head or helmeted area exceeded the predetermined impact level.

Also, in one or more embodiments, each of the light-emitting diodes 32*a*', 32*b*', or the light-emitting diodes 32*a*', 32*b*', 32*c*', 32*d*' (if four lights are used instead of two), may pass through an aperture 86 in the printed circuit board 56' such that the light produced by the light-emitting diodes 32*a*', 32*b*', 32*c*', 32*d*' is visible through two opposed sides of the unit housing 80 (e.g., see FIGS. 38 and 40 which diagrammatically illustrate portions of the light-emitting diodes 32*a*', 32*b*' disposed on both sides of the printed circuit board 56' with the diodes 32*a*', 32*b*' passing through apertures 86). Alternatively, the light-emitting diodes 32*a*', 32*b*' or the light-emitting diodes 32*a*', 32*b*', 32*c*', 32*d*' may be disposed on a single side of the printed circuit board 56', and a respective aperture disposed proximate to each of the light-emitting diodes 32*a*', 32*b*' or 32*a*', 32*b*', 32*c*', 32*d*' may simply allow the light produced by the light-emitting diodes 32*a*', 32*b*' or 32*a*', 32*b*', 32*c*', 32*d*' to pass through the aperture, and thus be visible on both opposed sides of the unit housing 80.

In the illustrative embodiment, the electrical components on the printed circuit board (PCB) 56' of the device 900 are pre-programmed with the abovedescribed functionality, and remain in the "on" state at all times. After the assembly of the printed circuit board 56' and its constituent electrical components, the unit housing 80, which may be molded from a suitable plastic or silicone, is affixed to the printed circuit board 56', and permanently encases the printed circuit board 56' and its constituent electrical components such that an end user is not able to access any of the constituent electrical components on the board 56'. As such, because the printed circuit board 56' and its constituent electrical components are permanently encased within the unit housing 80, the end user is not able to alter any of the functions performed by the electrical components of the device 900 that are mounted on the printed circuit board 56'. Thus, in accordance with the illustrative embodiment, the end user cannot turn "on" or "off" the device 900, manually reset the device 900, or connect the device 900 to any other electrical device.

In the illustrative embodiment, once the printed circuit board 56' and its constituent electrical components are permanently encased within the unit housing 80, the device 900 is initially in its sleep mode or inactive mode until the device 900 experiences an external force acting thereon so as to bring about the consequential movement or displacement of the device 900. Once the device 900 undergoes a displacement, the motion sensor 76 activates the microcontroller 60 to switch the entire device 900 to its active mode, and the one or more green-colored light-emitting diodes 32*a*' 32*c*' illuminate. Then, once the accelerometer 44' of the device 900 has sensed a sustained impact value (i.e., an acceleration) that equals or exceeds the predetermined impact level (i.e., threshold acceleration level) preprogrammed in the device 900, all of the light-emitting diodes 32*a*', 32*b*', 32*c*', 32*d*' will begin flashing for a predetermined period of time and will continually flash until that time period has elapsed (e.g., 5 minutes).

Then, in the illustrative embodiment, once the preprogrammed time limit (e.g., 5 minutes) has elapsed, the microcontroller 60 resets all the settings back to the original "on" settings (or alternatively, the microcontroller 60 instructs the reset device 34 to reset the device settings), and the one or more green-colored light-emitting diodes 32*a*' 32*c*' illuminate to indicate to the end user that the device 900 is ready to use again. After being reset, if the device 900 continues to undergo displacement (e.g., if the end user on which it is attached remains actively playing a sport), the device 900 remains in its active mode. Conversely, if after being reset, the device 900 is inactive for a predetermined period of time (e.g., 3 minutes), the device 900 will again enter its sleep mode or inactive mode. This abovedescribed process repeats itself every time the minimum threshold of impact is reached.

When the device 900 underdoes a displacement or movement, and the one or more green-colored light-emitting diodes 32*a*' 32*c*' do not illuminate, then the device 900 is no longer properly functioning and/or the battery 46' is no longer able to deliver the requisite power to the device 900, and the device 900 should not be used by the end user. When this occurs, the device 900 should be discarded by the end user, and replaced with a new device 900. In the illustrative embodiment, the device 900 is in the form of a disposable device. The electrical components of the device 900 are not able to be repaired or replaced by the end user, and the battery 46' of the device 900 is not able to be replaced by the end user. Advantageously, to prevent an end user from tampering with the settings of the device 900, there is no human interaction with the device 900 at all. Rather, the device 900 is preprogrammed with the necessary settings, and has the ability to reset itself when it has been activated by an impact exceeding the predetermined threshold.

As briefly mentioned above, the rear side of the housing 80 of the head-mounted impact sensing and warning device 900 is provided with a clipping mechanism 48' for securing the device 900 to a headband or strap. With reference to FIGS. 39 and 40, it can be seen that the clipping mechanism 48' generally comprises a clip base portion 49, a first clip portion 51 hingedly connected to the clip base portion 49, and a second clip portion 53 hingedly connected to the clip base portion 49. In FIG. 40, it can be seen that the first clip portion 51 is hingedly connected to the clip base portion 49 of the clipping mechanism 48' by a first flexible hinge 82, while the second clip portion 53 is hingedly connected to the clip base portion 49 of the clipping mechanism 48' by a second flexible hinge 84. The first clip portion 51 is configured to elastically deform and rotate relative to the clip base portion 49 about the flexible hinge 82. Similarly, the first clip portion 53 is configured to elastically deform and rotate relative to the clip base portion 49 about the flexible hinge 84.

In one or more embodiments, like the clipping mechanism 48 described above, the clipping mechanism 48' is formed from a resilient polymer, silicone, or rubber material (i.e., a resilient plastic, silicone, or rubber) so that the first clip portion 51 is capable of being displaced relative to the clip base portion 49 (about hinge 82), and the second clip portion 53 is capable of being displaced relative to the clip base portion 49 (about hinge 84) so that the clipping mechanism 48' can be attached to various headbands, bandanas or straps securing glasses or goggles. As such, the resilient polymer, silicone or rubber construction of the clipping mechanism 48' would allow the first and second clip portions 51, 53 to be elastically deformed as needed for attachment to various objects.

It is readily apparent that the aforedescribed head-mounted impact sensing and warning device offers numerous advantages. First, one or more embodiments of the head-mounted impact sensing and warning device enable 1 to 360 degree impact detection so as to allow full range measurement of g-forces on and around the head/skull area. Secondly, the head-mounted impact sensing and warning device is capable of showing a variation of g-force measurement with the use of an illuminating light or change in liquid color.

Advantageously, the aforedescribed head-mounted impact sensing and warning device does not employ overly complex, expensive, or remote components. Specifically, the head-mounted impact sensing and warning device also has all of the necessary components in a single housing (i.e., in a self-contained housing); it does not send a signal to a remote device that is located external to the impact sensing and warning assembly 10. Also, in the illustrated embodiments, the head-mounted impact sensing and warning device does not transfer data or information to a plug in the device for the external processing thereof (i.e., it does not contain any sort of data plug or connector for externally transferring data). Moreover, the head-mounted impact sensing and warning device of the aforedescribed embodiments does not plug into, or connect to, any external device for downloading or transferring data. In addition, the head-mounted impact sensing and warning device of the exemplary embodiments does not store data for the purpose of transmitting that data to another externally-located device (i.e., when data is stored by the head-mounted impact sensing and warning device, it is only stored for subsequent processing within its self-contained housing). Furthermore, in the illustrated embodiments, the head-mounted impact sensing and warning device does not communicate with an externally-located portable or electronic device (e.g., a PDA, a smart phone, a tablet, etc.), nor does it communicate with an externally-located computing device (e.g., a laptop or palmtop computer).

Any of the features or attributes of the above described embodiments and variations can be used in combination with any of the other features and attributes of the above described embodiments and variations as desired.

Although the invention has been shown and described with respect to a certain embodiment or embodiments, it is apparent that this invention can be embodied in many different forms and that many other modifications and variations are possible without departing from the spirit and scope of this invention.

Moreover, while exemplary embodiments have been described herein, one of ordinary skill in the art will readily appreciate that the exemplary embodiments set forth above are merely illustrative in nature and should not be construed as to limit the claims in any manner. Rather, the scope of the invention is defined only by the appended claims and their equivalents, and not, by the preceding description.

The invention claimed is:

1. A head-mounted impact sensing and warning device comprising, in combination:

a band adapted to be worn around at least a portion of the head or helmeted area of a user;

an impact sensing device configured to sense an impact sustained by said head or said helmeted area of said user, said impact sensing device being capable of 360 degree impact measurement, thereby allowing full range measurement of g-forces on and around said head or said helmeted area of said user;

at least one visual indicating device operatively coupled to said impact sensing device, said at least one visual indicating device configured to produce a visual indicator when said impact sensing device senses an impact that exceeds a predetermined impact level, thereby providing a visual alert that said impact sustained by said head or said helmeted area of said user exceeded said predetermined impact level;

a microcontroller operatively coupled to said impact sensing device and said at least one visual indicating device, said microcontroller configured to process impact data sensed by said impact sensing device, and to selectively activate said at least one visual indicating device when an impact sensed by said impact sensing device exceeds said predetermined impact level;

a motion sensing device, said motion sensing device being a component that is separate from said impact sensing device, said motion sensing device configured to sense a motion imparted on said head-mounted impact sensing and warning device by one or more external forces and to output a signal to said microcontroller, whereby, upon receiving said signal from said motion sensing device, said microcontroller is configured to activate said impact sensing device and to change said head-mounted impact sensing and warning device from an inactive mode to an active mode for a predetermined period of time; and a unit housing containing said impact sensing device, said at least one visual indicating device, said microcontroller, and said motion sensing device, said unit housing being coupled to said band or said helmeted area;

wherein said at least one visual indicating device is disposed within said unit housing, and wherein said unit housing is substantially transparent such that said visual indicator produced by said at least one visual indicating device is visible through said unit housing.

2. The head-mounted impact sensing and warning device according to claim 1, wherein said band comprises one of the following: (i) a headband; (ii) a bandana; and (iii) a strap for securing glasses or goggles around said head or said helmeted area of said user.

3. The head-mounted impact sensing and warning device according to claim 1, wherein said band comprises one of the following materials: (i) a moisture-wicking material; (ii) polyester; (iii) a moisture management antimicrobial performance fabric; (iv) spandex; (v) cotton; (vi) a cotton blend; (vii) a polyester/spandex mix; (viii) elastic; (ix) leather; (x) nylon; (xi) silicone; and (xii) rubber.

4. The head-mounted impact sensing and warning device according to claim 1, wherein said impact sensing device comprises an accelerometer.

5. The head-mounted impact sensing and warning device according to claim 1, wherein said at least one visual indicating device comprises at least one light emitting device, said at least one light emitting device configured to emit one or more beams of light when said impact sensing device senses an impact exceeding said predetermined impact level.

6. The head-mounted impact sensing and warning device according to claim 5, further comprising a power source for powering said impact sensing device, said at least one light emitting device, said microcontroller, and said motion sensing device.

7. The head-mounted impact sensing and warning device according to claim 1, wherein said unit housing containing said impact sensing device, said at least one visual indicating device, said microcontroller, and said motion sensing device is attached to said band by means of a clipping mechanism, said clipping mechanism including a first clip member, a second clip member, and one or more flexible hinges connecting said first clip member to said second clip member, said second clip member configured to rotate relative to said first clip member, said clipping mechanism being integrally formed with said unit housing.

8. The head-mounted impact sensing and warning device according to claim 1, wherein said unit housing containing said impact sensing device, said at least one visual indicating device, said microcontroller, and said motion sensing device is removably disposed within at least one pocket of said band, said at least one pocket being formed between layers of said band or being attached to a front layer of said band, said at least one pocket including at least one aperture or a viewing window such that said visual indicator produced by said at least one visual indicating device is externally visible.

9. The head-mounted impact sensing and warning device according to claim 1, wherein said impact sensing device comprises an accelerometer operatively connected to a circuit board having a front side and a rear side, said front side of said circuit board being oppositely disposed relative to said rear side, said at least one visual indicating device comprises at least one light emitting device, and wherein said head-mounted impact sensing and warning device further comprises a battery operatively coupled to said accelerometer, said at least one light emitting device, said microcontroller, and said motion sensing device; said accelerometer, said at least one light emitting device, said microcontroller, and said motion sensing device being attached to said front side of said circuit board; said battery configured to power said accelerometer, said at least one light emitting device, said microcontroller, and said motion sensing device; said battery being attached to said rear side of said circuit board by a battery clip.

10. The head-mounted impact sensing and warning device according to claim 9, further comprising a reset device for resetting said head-mounted impact sensing and warning device back to an original setting after said at least one light emitting device has emitted one or more beams of light indicative of said impact sensing device sensing an impact exceeding said predetermined impact level.

11. A head-mounted impact sensing and warning device comprising, in combination:

a band adapted to be worn around at least a portion of the head or helmeted area of a user;

a unit housing coupled to said band;

a clipping mechanism attached to said unit housing;

an acceleration sensing device configured to sense an acceleration sustained by said head or said helmeted area of said user, said acceleration sensing device being capable of 360 degree acceleration measurement, thereby allowing full range measurement of g-forces on and around said head or said helmeted area of said user, said acceleration sensing device disposed inside said unit housing;

a plurality of visual indicating devices operatively coupled to said acceleration sensing device within said unit housing, one of said plurality of visual indicating devices configured to illuminate when said head-mounted impact sensing and warning device is in an active mode, each of said plurality of visual indicating devices configured to produce a flashing visual indicator for a predetermined period of time when said acceleration sensing device senses an acceleration that exceeds a predetermined acceleration value, thereby providing a visual alert that an impact sustained by said head or said helmeted area of said user exceeded said predetermined acceleration value, said plurality of visual indicating devices being disposed within said unit housing, and said unit housing being substantially transparent such that said visual indicators produced by said plurality of visual indicating devices are visible through said unit housing;

a microcontroller operatively coupled to said acceleration sensing device and said plurality of visual indicating devices, said microcontroller configured to process acceleration data sensed by said acceleration sensing device, and to selectively activate said plurality of visual indicating devices when said predetermined acceleration value is exceeded;

a motion sensing device, said motion sensing device being a component that is separate from said acceleration sensing device, said motion sensing device configured to sense a motion imparted on said head-mounted impact sensing and warning device by one or more external forces and to output a signal to said microcontroller, whereby, upon receiving said signal from said motion sensing device, said microcontroller is configured to activate said acceleration sensing device and to change said head-mounted impact sensing and warning device from an inactive mode to said active mode for a predetermined period of time; and a power source operatively coupled to said acceleration sensing device, said plurality of visual indicating devices, said microcontroller, and said motion sensing device, said power source configured to power said acceleration sensing device, said microcontroller, said motion sensing device, and each of said plurality of visual indicating devices.

12. The head-mounted impact sensing and warning device according to claim 11, wherein said acceleration sensing device comprises an accelerometer, said accelerometer configured to measure the magnitude of linear and rotational acceleration, said accelerometer further configured to detect the direction of said acceleration, and to measure peak acceleration and a duration of an acceleration pulse.

13. The head-mounted impact sensing and warning device according to claim 12, wherein said predetermined acceleration value is determined by a predetermined acceleration setting of said accelerometer, said predetermined acceleration setting of said accelerometer being adjustable in the range from approximately 5 g forces to approximately 500 g forces, and said predetermined acceleration setting of said accelerometer being adjustable in increments of approximately 2 g forces.

14. The head-mounted impact sensing and warning device according to claim 11, wherein said acceleration sensing device is operatively connected to a circuit board, and each of said plurality of visual indicating devices comprises a light emitting device.

15. The head-mounted impact sensing and warning device according to claim 14, wherein at least one of said plurality of visual indicating devices passes through an aperture in said circuit board such that said visual indicator produced by said at least one of said plurality of visual indicating devices is visible through two opposed sides of said unit housing.

16. A head-mounted impact sensing and warning device comprising, in combination:

a band adapted to be worn around at least a portion of the head or helmeted area of a user;

a unit housing coupled to said band;

an accelerometer configured to sense an acceleration sustained by said head or said helmeted area of said user and to output a signal comprising acceleration data, said accelerometer being capable of 360 degree acceleration measurement, thereby allowing full range measurement of g-forces on and around said head or said helmeted area of said user, said accelerometer disposed inside said unit housing;

at least one capacitor operatively coupled to said accelerometer, said at least one capacitor configured to set a bandwidth of said accelerometer to a predetermined sampling frequency, said at least one capacitor disposed inside said unit housing;

a plurality of light emitting devices operatively coupled to said accelerometer within said unit housing, each of said plurality of light emitting devices configured to emit one or more beams of light when said accelerometer senses an acceleration that exceeds a predetermined acceleration value, thereby providing a visual alert that an impact sustained by said head or said helmeted area of said user exceeded said predetermined acceleration value, said plurality of light emitting devices being disposed within said unit housing, and said unit housing being substantially transparent such that said beams of light emitted by said plurality of light emitting devices are visible through said unit housing;

a microcontroller operatively coupled to said accelerometer and said plurality of light emitting devices, said microcontroller configured to process acceleration data sensed by said accelerometer, and to selectively activate said plurality of light emitting devices when said acceleration sensed by said accelerometer exceeds said predetermined acceleration value, said microcontroller disposed inside said unit housing; and a power source operatively coupled to said accelerometer, said plurality of light emitting devices, and said microcontroller, said power source configured to power said accelerometer, each of said plurality of light emitting devices, and said microcontroller, said power source disposed inside said unit housing.

17. The head-mounted impact sensing and warning device according to claim 16, wherein said unit housing comprises a clipping mechanism attached to a side thereof, said clipping mechanism including a base portion and at least one clip portion, said at least one clip portion being connected to said base portion of said clipping mechanism by a flexible hinge, and said at least one clip portion being configured to rotate relative to said base portion of said clipping mechanism about said flexible hinge.

18. The head-mounted impact sensing and warning device according to claim 9, wherein said head-mounted impact sensing and warning device is in the form of a disposable device, and said impact sensing device, said at least one visual indicating device, said microcontroller, said motion sensing device, and said battery are permanently encased within said unit housing so that these components are not able to be repaired or replaced by a user.

19. The head-mounted impact sensing and warning device according to claim 14, wherein said plurality of visual indicating devices comprises a first subset of visual indicating devices disposed at a first end of said circuit board and a second subset of visual indicating devices disposed at a second end of said circuit board, said first end of said circuit board being oppositely disposed relative to said second end, wherein one said visual indicating device from each of said first and second subsets is configured to illuminate when said head-mounted impact sensing and warning device is in said active mode, and wherein each of said plurality of visual indicating devices from said first and second subsets are configured to produce said flashing visual indicator for said predetermined period of time when said acceleration sensing device senses an acceleration that exceeds said predetermined acceleration value.

* * * * *